US012679679B2

(12) United States Patent
Ito

(10) Patent No.: US 12,679,679 B2
(45) Date of Patent: Jul. 14, 2026

(54) MEDIA FEEDING APPARATUS, MEDIA FEEDING METHOD, AND NON-TRANSITORY RECORDING MEDIUM

(71) Applicant: PFU LIMITED, Kahoku (JP)

(72) Inventor: Takumi Ito, Kahoku (JP)

(73) Assignee: PFU LIMITED, Kahoku (JP)

( * ) Notice: Subject to any disclaimer, the term of this patent is extended or adjusted under 35 U.S.C. 154(b) by 0 days.

(21) Appl. No.: 18/752,279

(22) Filed: Jun. 24, 2024

(65) Prior Publication Data

US 2025/0002278 A1 Jan. 2, 2025

(30) Foreign Application Priority Data

Jun. 29, 2023 (JP) ..... 2023-106981

(51) Int. Cl.

| | |
|---|---|
| ***B65H 3/06*** | (2006.01) |
| ***B65H 1/14*** | (2006.01) |
| ***B65H 7/02*** | (2006.01) |
| ***B65H 7/06*** | (2006.01) |

(52) U.S. Cl.

CPC ..... *B65H 3/0684* (2013.01); *B65H 1/14* (2013.01); *B65H 7/02* (2013.01); *B65H 7/06* (2013.01); *B65H 2515/34* (2013.01)

(58) Field of Classification Search

CPC ..... B65H 1/14; B65H 3/0684; B65H 3/46; B65H 3/54; B65H 7/02; B65H 7/06; B65H 7/18; B65H 2515/34

See application file for complete search history.

(56) References Cited

U.S. PATENT DOCUMENTS

| | | | | |
|---|---|---|---|---|
| 7,857,304 | B2 * | 12/2010 | Koizumi | B65H 7/18 271/154 |
| 2007/0165089 | A1 | 7/2007 | Kozaki et al. | |
| 2015/0203307 | A1 * | 7/2015 | Tanaka | B65H 3/5215 271/121 |
| 2017/0345244 | A1 * | 11/2017 | Wada | B65H 1/26 |
| 2022/0009734 | A1 | 1/2022 | Numata | |
| 2022/0033205 | A1 * | 2/2022 | Shibazaki | B65H 7/02 |

FOREIGN PATENT DOCUMENTS

| | | | |
|---|---|---|---|
| JP | 2007-168996 | A | 7/2007 |
| JP | 2008-37575 | A | 2/2008 |
| JP | 2022-16966 | A | 1/2022 |

* cited by examiner

*Primary Examiner* — Prasad V Gokhale
(74) *Attorney, Agent, or Firm* — Womble Bond Dickinson (US) LLP

(57) ABSTRACT

A media feeding apparatus includes a media table on which a medium is placed; a pick roller disposed above the table to feed the medium on the table; a pressing member to apply a downward pressing force to the roller; and circuitry that controls the table to be raised to press the medium toward the roller when a leading end of the medium does not reach a predetermined position within a predetermined time from start of feeding the medium or when a moving speed of the medium during feeding is equal to or lower than a predetermined speed. The roller is moved from a first position to a second position higher than the first position when the table is raised. The pressing member does not apply the force to the roller at the first position and applies the force to the roller at the second position.

7 Claims, 14 Drawing Sheets

MEDIA FEEDING APPARATUS, MEDIA FEEDING METHOD, AND NON-TRANSITORY RECORDING MEDIUM

CROSS-REFERENCE TO RELATED APPLICATION

This patent application is based on and claims priority pursuant to 35 U.S.C. § 119(a) to Japanese Patent Application No. 2023-106981, filed on Jun. 29, 2023, in the Japan Patent Office, the entire disclosure of which is hereby incorporated by reference herein.

BACKGROUND

The present disclosure relates to a media feeding apparatus, a media feeding method, and a non-transitory recording medium.

Media feeding apparatuses, such as scanners, are required to support various types of media. When a roller that feeds media presses media with excessive force in such a media feeding apparatus, for example, jamming or multiple feeding of media may occur. By contrast, when the roller that feeds media presses media with insufficient force, the media may slip depending on the type of media. As a result, the roller may fail to feed the media.

SUMMARY

According to an embodiment of the present disclosure, a media feeding apparatus includes a media table on which a medium is placed, a pick roller, a pressing member, and circuitry. The pick roller is disposed above the media table to feed the medium placed on the media table. The pressing member applies a downward pressing force to the pick roller. The circuitry controls the media table to be raised to press the medium placed on the media table toward the pick roller when a leading end of the medium does not reach a predetermined position within a predetermined time from start of feeding the medium or when a moving speed of the medium during feeding is equal to or lower than a predetermined speed. The pick roller is moved from a first position to a second position when the media table is raised. The second position is higher than the first position. The pressing member does not apply the pressing force to the pick roller when the pick roller is at the first position. The pressing member applies the pressing force to the pick roller when the pick roller is at the second position.

According to an embodiment of the present disclosure, a media feeding method includes feeding, by a pick roller, a medium placed on a media table; raising the media table to press the medium placed on the media table toward the pick roller when a leading end of the medium does not reach a predetermined position within a predetermined time from start of feeding the medium or when a moving speed of the medium during feeding is equal to or lower than a predetermined speed, the pick roller being moved from a first position to a second position when the media table is raised, the second position being higher than the first position; and not applying, by a pressing member, a downward pressing force to the pick roller when the pick roller is at the first position, and applying, by the pressing member, the pressing force to the pick roller when the pick roller is at the second position.

According to an embodiment of the present disclosure, a non-transitory recording medium stores a plurality of instructions which, when executed by one or more processors, causes the one or more processors to perform a method. The method includes raising a media table to press a medium placed on the media table toward a pick roller when a leading end of the medium does not reach a predetermined position within a predetermined time from start of feeding the medium or when a moving speed of the medium during feeding is equal to or lower than a predetermined speed, the pick roller being moved from a first position to a second position when the media table is raised, the second position being higher than the first position; and not applying, by a pressing member, a downward pressing force to the pick roller when the pick roller is at the first position, and applying, by the pressing member, the pressing force to the pick roller when the pick roller is at the second position.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
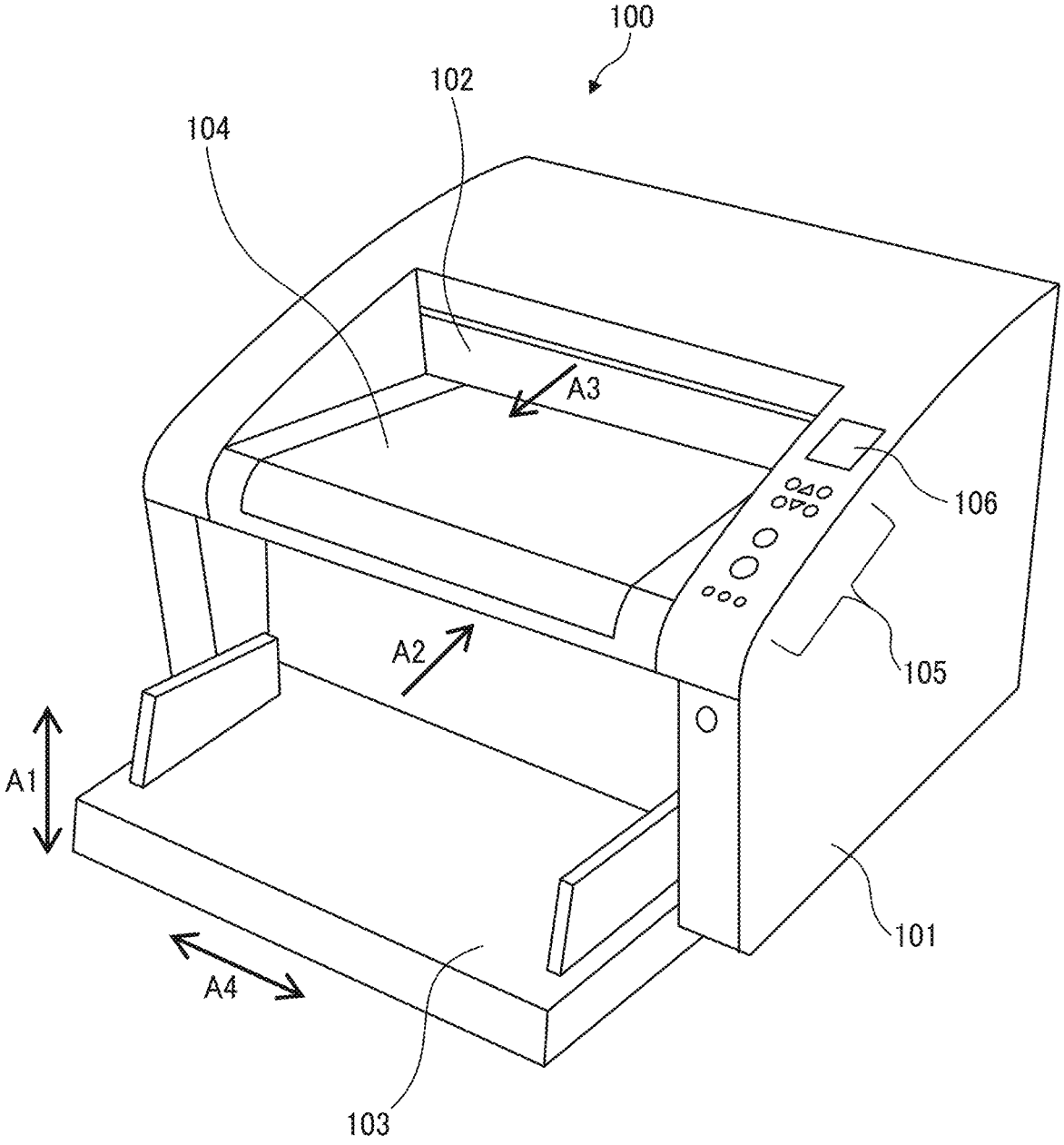
FIG. 1 is a perspective view of a media feeding apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a," "an," and "the" are intended to include the plural forms as well, unless the context clearly indicates otherwise.

For the sake of simplicity, like reference signs denote like elements such as parts and materials having the same functions, and redundant descriptions thereof are omitted unless otherwise required.

As used herein, the term "connected/coupled" includes both direct connections and connections in which there are one or more intermediate connecting elements.

A description is given below of a media feeding apparatus, a media feeding method, and a control program according to embodiments of the present disclosure, with reference to the drawings. The technical scope of the present disclosure, however, is not limited to the embodiments described below but includes the scope of the appended claims and the equivalents thereof.

FIG. 1 is a perspective view of a media feeding apparatus 100 as an image scanner. The media feeding apparatus 100 conveys and images media, which are documents. The media are, for example, sheets of plain paper, sheets of thick paper, or cards. Alternatively, the media feeding apparatus 100 may be, for example, a facsimile machine, a copier, or a multifunction peripheral (MFP). The media to be conveyed may be, for example, printing material (e.g., paper sheets) instead of documents. In this case, the media feeding apparatus 100 may be, for example, a printer.

In FIG. 1, arrow A1 indicates a substantially vertical direction (height direction). Arrow A2 indicates a media conveyance direction in which media are conveyed. Arrow A3 indicates a media ejection direction in which media are ejected. Arrow A4 indicates a width direction orthogonal to the media conveyance direction indicated by arrow A2 or the media ejection direction indicated by arrow A3. In the following description, the height direction indicated by arrow A1, the media conveyance direction indicated by arrow A2, the media ejection direction indicated by arrow A3, and the width direction indicated by arrow A4 may be referred to as a height direction A1, a media conveyance direction A2, a media ejection direction A3, and a width direction A4, respectively. In the following description, "upstream" refers to "upstream" in the media conveyance direction A2 or the media ejection direction A3, whereas "downstream" refers to "downstream" in the media conveyance direction A2 or the media ejection direction A3.

The media feeding apparatus 100 includes, for example, a first housing 101, a second housing 102, a media table 103, an ejection table 104, an operation device 105, and a display device 106.

The second housing 102 is disposed inside the first housing 101 and is rotatably engaged with the first housing 101 with a hinge such that the second housing 102 can be opened and closed to, for example, remove a jammed medium or clean the inside of the media feeding apparatus 100.

The media table 103 is engaged with the first housing 101 such that the media to be conveyed are placed on the media table 103. The media table 103 is movable in the height direction A1, that is, up and down, on a media-supply side of the first housing 101. The media-supply side of the first housing 101 is the side from which the media are supplied into the first housing 101. When no medium is conveyed, the media table 103 is positioned at the lower end in the movable range of the media table 103 to facilitate the placement of media on the media table 103. When a medium is conveyed, the media table 103 is raised to a position so that the uppermost medium of the media on the media table 103 comes into contact with a pick roller described later.

The ejection table 104 is formed on the second housing 102. The ejection table 104 stacks the media ejected from an ejection port defined by the first housing 101 and the second housing 102.

The operation device 105 includes an input device such as keys and an interface circuit that acquires signals from the input device. The operation device 105 receives an input operation performed by a user and outputs an operation signal corresponding to the input operation performed by the user. The display device 106 includes a display and an interface circuit that outputs image data to the display, to display the image data on the display. Examples of the display include, but are not limited to, a liquid crystal and an organic electro-luminescence (EL). The display device 106 may be a liquid crystal display with a touch panel function. In this case, the operation device 105 includes an interface circuit that acquires input signals from the touch panel.

Figure 2:
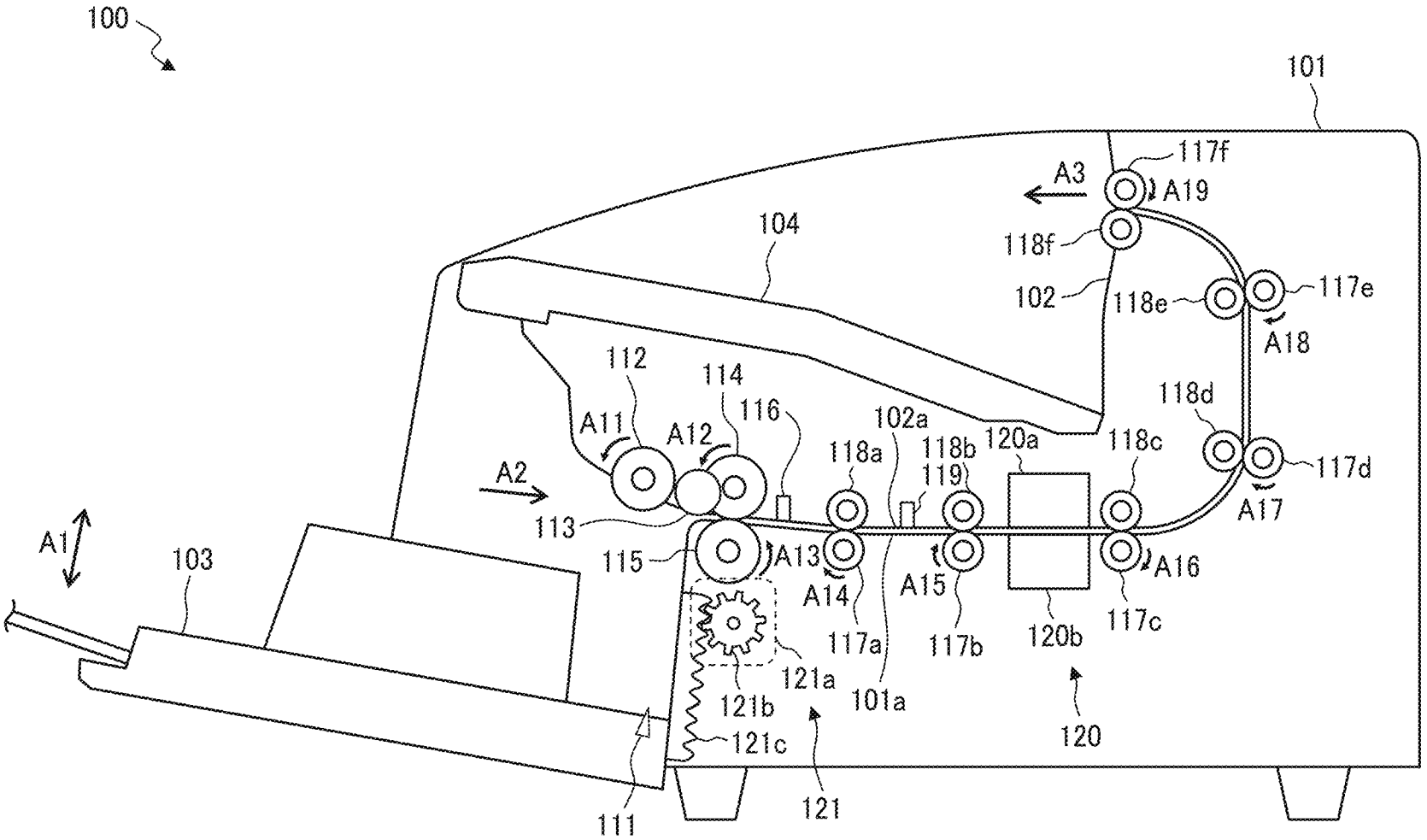
FIG. 2 is a diagram illustrating a conveyance passage inside the media feeding apparatus of FIG. 1.

FIG. 2 is a diagram illustrating a conveyance passage inside the media feeding apparatus 100.

For example, the media feeding apparatus 100 includes, along the conveyance passage, a first media sensor 111, a pick roller 112, a speed sensor 113, a feed roller 114, a separation roller 115, a second media sensor 116, first to sixth conveyance rollers 117*a* to 117*f*, first to sixth driven rollers 118*a* to 118*f*, a third media sensor 119, an imaging device 120, and a moving assembly 121.

The number of each of the pick roller 112, the feed roller 114, the separation roller 115, the first to sixth conveyance rollers 117*a* to 117*f*, and/or the first to sixth driven rollers 118*a* to 118*f* is not limited to one but may be two or more. In this case, the two or more rollers of the feed rollers 114, the separation rollers 115, the first to sixth conveyance rollers 117*a* to 117*f*, and/or the first to sixth driven rollers 118*a* to 118*f* are aligned and spaced apart in the width direction A4.

The second housing 102 faces the first housing 101 across a media conveyance passage in which media are conveyed. The first housing 101 has a face that faces the second housing 102. The face of the first housing 101 serves as a first guide 101*a* of the media conveyance passage. The second housing 102 has a face that faces the first housing 101. The face of the second housing 102 serves as a second guide 102*a* of the media conveyance passage.

The first media sensor 111 is disposed on the media table 103, that is, upstream from the feed roller 114 and the separation roller 115. The first media sensor 111 detects how media are placed on the media table 103. The first media sensor 111 determines whether a medium is placed on the media table 103 using a contact sensor that allows a predetermined amount of electrical current to flow when a medium is in contact with the sensor or no medium is in contact with the sensor. The first media sensor 111 generates and outputs a first media signal whose signal value changes depending on whether a medium is present on the media table 103. The first media sensor 111 is not limited to the contact sensor. The first media sensor 111 may be any other sensor that can detect the presence of a medium such as an optical sensor.

The pick roller 112 is disposed upstream from the feed roller 114 and the separation roller 115 in the media conveyance direction A2 in the second housing 102. The pick roller 112 is disposed above the media table 103 and feeds media placed on the media table 103. Specifically, the pick roller 112 contacts the uppermost medium of the media on the media table 103, which is raised to substantially the same height as the height of the media conveyance passage, and feeds the medium downstream in the media conveyance passage.

The speed sensor 113 is disposed, in the second housing 102, downstream from the pick roller 112 and upstream from the feed roller 114 and the separation roller 115 in the media conveyance direction A2, particularly, near the feed roller 114, and detects the moving speed (feeding speed) of the fed medium. The speed sensor 113 is, for example, an encoder and includes a disk, a light emitter, and a light receiver. The disk has a large number of slits (light transmission holes) and rotates with the fed medium. The light emitter and the light receiver face each other across the disk. The light emitter is, for example, a light emitting diode (LED) and emits light toward the disk (the light receiver). The light receiver is, for example, a photodiode and receives, through the disk, the light emitted by the light emitter. The light receiver detects the number of changes within a predetermined period from a state where the slit is present between the light emitter and the light receiver to a state where the slit is absent between the light emitter and the light receiver and the light is blocked by the disk. The light receiver multiplies the detected number of changes by the distance traveled by the fed medium while the disk rotates by the distance between the two adjacent slits. In this way, the light receiver detects, as a moving distance, the distance traveled by the fed medium. The light receiver divides the detected moving distance by a predetermined period in which the number of changes is detected, to detect the moving speed of the fed medium. The speed sensor 113 generates and outputs a speed signal indicating the detected moving speed.

The speed sensor 113 is not limited to an optical encoder but may be any encoder such as a mechanical encoder, a magnetic encoder, or an electromagnetic induction encoder. The speed sensor 113 may be an optical sensor. The optical sensor includes a light emitter and a light receiver. The light emitter is, for example, an LED and emits light toward the uppermost medium of the media placed on the media table 103, that is, the medium to be fed. The light receiver captures images corresponding to the light received at regular intervals. The light receiver detects a common portion from the latest image and the immediately preceding image. The light receiver detects the moving direction and the moving amount of the fed medium, based on the changes in the position within the common image detected. The light receiver divides the amount of movement in the media conveyance direction A2 by a predetermined period, which is the interval at which images are captured, to detect the moving speed of the fed medium.

The feed roller 114 is disposed downstream from the pick roller 112 in the second housing 102 and feeds the medium fed from the media table 103 by the pick roller 112 further downstream in the media conveyance passage. The separation roller 115 faces the feed roller 114 in the first housing 101. The separation roller 115 is a so-called brake roller and is stoppable. The feed roller 114 and the separation roller 115 function as separators that perform a separation operation of media. Specifically, the feed roller 114 and the separation roller 115 separate the media to feed the media one by one. The feed roller 114 is disposed above the separation roller 115. With this configuration, the media feeding apparatus 100 feeds media from the top. A separation pad may be used instead of the separation roller 115.

The second media sensor 116 is disposed downstream from the feed roller 114 and the separation roller 115 and upstream from the first conveyance roller 117*a* and the first driven roller 118*a* in the media conveyance direction A2. The second media sensor 116 detects the medium fed to the position of the second media sensor 116. In particular, the second media sensor 116 is disposed near the feed roller 114 and the separation roller 115. The second media sensor 116 includes a light emitter, a light receiver, and a light guide tube. The light emitter and the light receiver are disposed on one side of the media conveyance passage. The light guide tube faces the light emitter and the light receiver across the media conveyance passage. The light emitter is, for example, an LED and emits light toward the media conveyance passage. By contrast, the light receiver is, for example, a photodiode and receives light that is emitted by the light emitter and guided by the light guide tube. Based on the intensity of the light received by the light receiver, the second media sensor 116 generates and outputs a second media signal whose signal value changes depending on whether a medium is present at the position of the second media sensor 116.

A reflector such as a mirror may be used instead of the light guide tube. The light emitter and the light receiver may face each other across the media conveyance passage. The second media sensor 116 may be any other sensor that can detect the presence of a medium, such as a contact sensor that allows a predetermined amount of electrical current to flow when a medium is in contact with the sensor or no medium is in contact with the sensor.

The first to sixth conveyance rollers 117*a* to 117*f* and the first to sixth driven rollers 118*a* to 118*f* are disposed downstream from the feed roller 114 and the separation roller 115 in the media conveyance direction A2 such that the first to sixth conveyance rollers 117*a* to 117*f* face the first to sixth driven rollers 118*a* to 118*f*, respectively. The first to sixth conveyance rollers 117*a* to 117*f* and the first to sixth driven rollers 118*a* to 118*f* convey the medium, which has been fed by the feed roller 114 and the separation roller 115, downstream in the media conveyance passage. The sixth conveyance roller 117*f* and the sixth driven roller 118*f* eject the medium to the ejection table 104.

The third media sensor 119 is disposed downstream from the first conveyance roller 117*a* and the first driven roller 118*a* and upstream from the second conveyance roller 117*b* and the second driven roller 118*b* in the media conveyance direction A2. The third media sensor 119 detects the medium conveyed to the position of the third media sensor 119. In particular, the third media sensor 119 is disposed near the first conveyance roller 117*a* and the first driven roller 118*a*. Alternatively, the third media sensor 119 may be disposed downstream from the second conveyance roller 117*b* and the second driven roller 118*b*. The third media sensor 119 includes a light emitter, a light receiver, and a light guide tube. The light emitter and the light receiver are disposed on one side of the media conveyance passage. The light guide tube faces the light emitter and the light receiver across the media conveyance passage. The light emitter is, for example, an LED and emits light toward the media conveyance passage. By contrast, the light receiver is, for example, a photodiode and receives light that is emitted by the light emitter and guided by the light guide tube. Based on the intensity of the light received by the light receiver, the third media sensor 119 generates and outputs a third media signal whose signal value changes depending on whether a medium is present at the position of the third media sensor 119.

A reflector such as a mirror may be used instead of the light guide tube. The light emitter and the light receiver may face each other across the media conveyance passage. The third media sensor 119 may be any other sensor that can detect the presence of a medium, such as a contact sensor that allows a predetermined amount of electrical current to flow when a medium is in contact with the sensor or no medium is in contact with the sensor.

The imaging device 120 is disposed downstream from the first and second conveyance rollers 117*a* and 117*b* in the media conveyance direction A2 to image the medium conveyed by the first and second conveyance rollers 117*a* and 117*b* and the first and second driven rollers 118*a* and 118*b*. The imaging device 120 includes a first imaging device 120*a* and a second imaging device 120*b* facing each other across the media conveyance passage. The first imaging device 120*a* is disposed in the second housing 102, whereas the second imaging device 120*b* is disposed in the first housing 101.

The first imaging device 120*a* includes, as a line sensor, a contact image sensor (CIS) employing an equal-magnification optical system and including, as imaging elements, complementary metal oxide semiconductors (CMOSs) aligned linearly in the main-scanning direction. The first imaging device 120*a* further includes a lens that forms an image on the imaging elements and an analog-to-digital (A/D) converter that amplifies the electric signals output from the imaging elements and performs analog-to-digital (A/D) conversion. The first imaging device 120*a* images the front side of the medium being conveyed, generates an input image, and outputs the input image.

Similarly, the second imaging device 120*b* includes, as a line sensor, a CIS employing the equal-magnification optical system and including, as imaging elements, CMOSs aligned linearly in the main-scanning direction. The second imaging device 120*b* further includes a lens that forms an image on the imaging elements and an A/D converter that amplifies the electric signals output from the imaging elements and performs A/D conversion. The second imaging device 120*b* images the back side of the medium being conveyed, generates an input image, and outputs the input image.

Alternatively, the media feeding apparatus 100 may include either the first imaging device 120*a* or the second imaging device 120*b* to read only one side of the medium. The line sensor may be, instead of the CIS employing the equal-magnification optical system and including CMOSs as imaging elements, a CIS employing the equal-magnification optical system and including charge-coupled devices (CCDs) as imaging elements. Alternatively, a line sensor employing a reduction optical system and including, as imaging elements, CMOSs or CCDs may be used.

As the pick roller 112 and the feed roller 114 rotate in media feeding directions A11 and A12, respectively, the medium is conveyed from the media table 103 in the media conveyance direction A2 between the first guide 101*a* and the second guide 102*a*. The media feeding apparatus 100 has two feeding modes: a separation mode in which media are fed while being separated and a non-separation mode in which media are fed without being separated. The feeding mode is set by the user using the operation device 105 or an information processing device connected to the media feeding apparatus 100 for communication. When the feeding mode is set to the separation mode, the separation roller 115 stops or rotates in the direction indicated by arrow A13 opposite to the media feeding direction. This operation prevents the feeding of a medium other than the separated medium. In short, the multiple feeding is prevented. By contrast, when the feeding mode is set to the non-separation mode, the separation roller 115 rotates in the media feeding direction opposite to the direction indicated by arrow A13.

As the first and second conveyance rollers 117*a* and 117*b* rotate in the directions indicated by arrows A14 and A15, respectively, the medium is fed to the imaging position in the imaging device 120 while being guided by the first guide 101*a* and the second guide 102*a*. At the imaging portion, the imaging device 120 images the medium. As the third to sixth conveyance rollers 117*c* to 117*f* rotate in the directions indicated by arrows A16 to A19, respectively, the medium is ejected onto the ejection table 104.

The moving assembly 121 raises and lowers the media table 103. The moving assembly 121 includes, for example, a first motor 121*a*, a pinion 121*b*, and a rack 121*c*. The pinion 121*b* and the rack 121*c* are disposed at one end or both ends of the media table 103 in the width direction A4. The first motor 121*a* rotates under the control of a processing circuit, which will be described later, and generates a driving force for raising and lowering the media table 103. The pinion 121*b* is attached to the shaft of the first motor 121*a* and meshed with the rack 121*c*. The rack 121*c* is movable up and down along a guide such as a rail extending in the height direction A1. The media table 103 is attached to the rack 121*c* and movable up and down in accordance with the rotation of the pinion 121*b*. The moving assembly 121 may raise and lower the media table 103 with a member such as a solenoid, a belt, and/or a cam, instead of or in addition to the motor, the pinion, and/or the rack.

Figure 3:
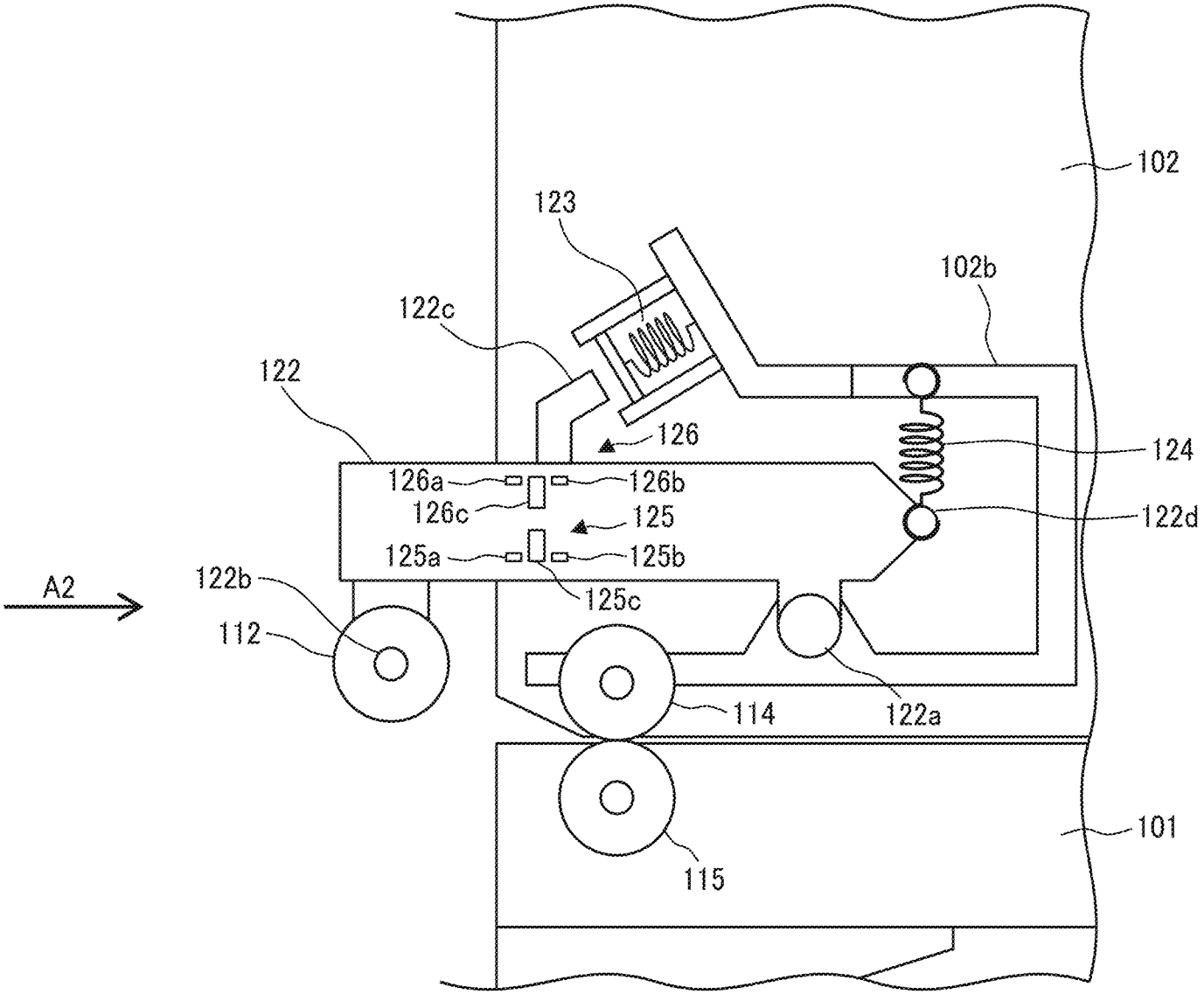
FIG. 3 is a schematic diagram illustrating a pick roller and surrounding components in the media feeding apparatus of FIG. 1.
Figure 4:
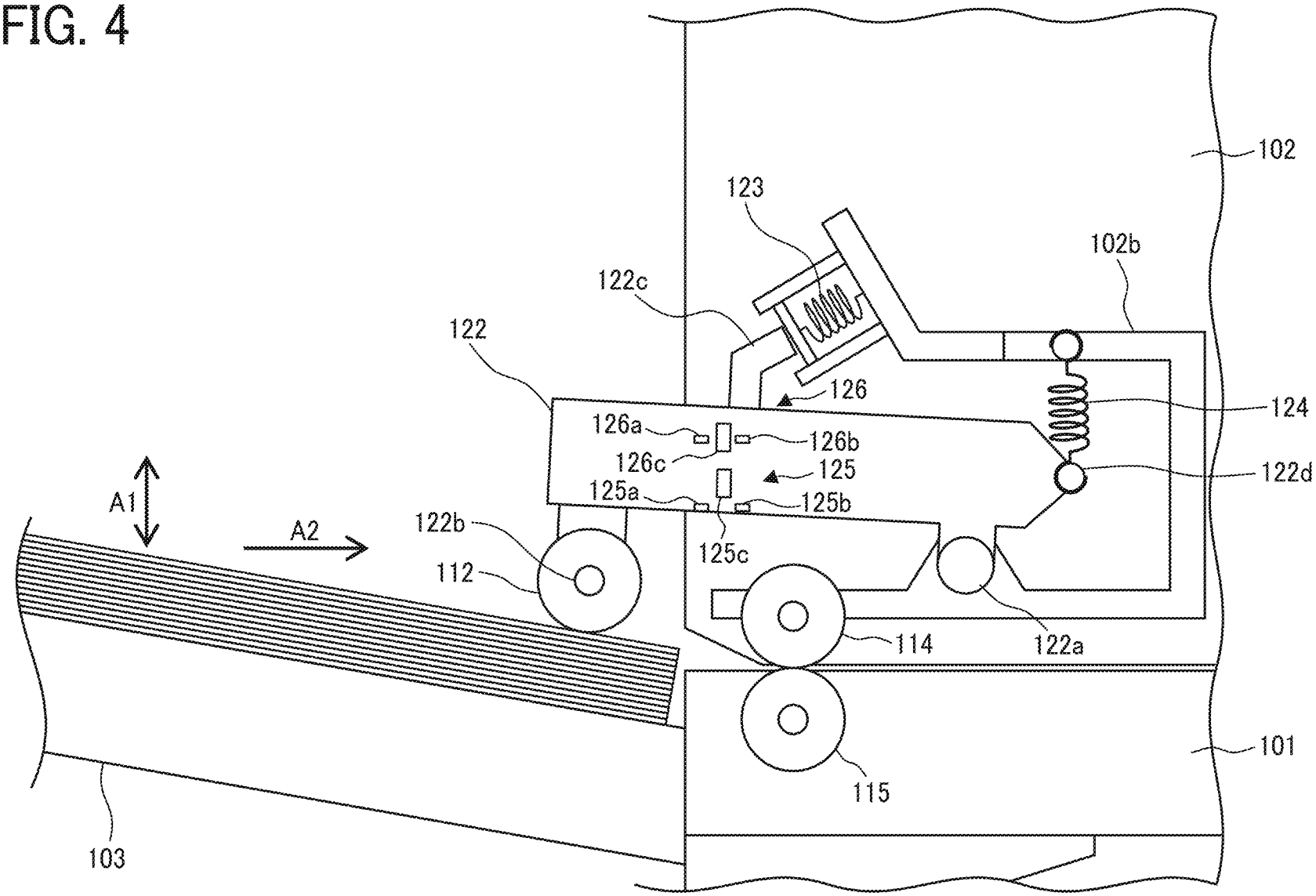
FIG. 4 is another schematic diagram illustrating the pick roller and the surrounding components of FIG. 3.
Figure 5:
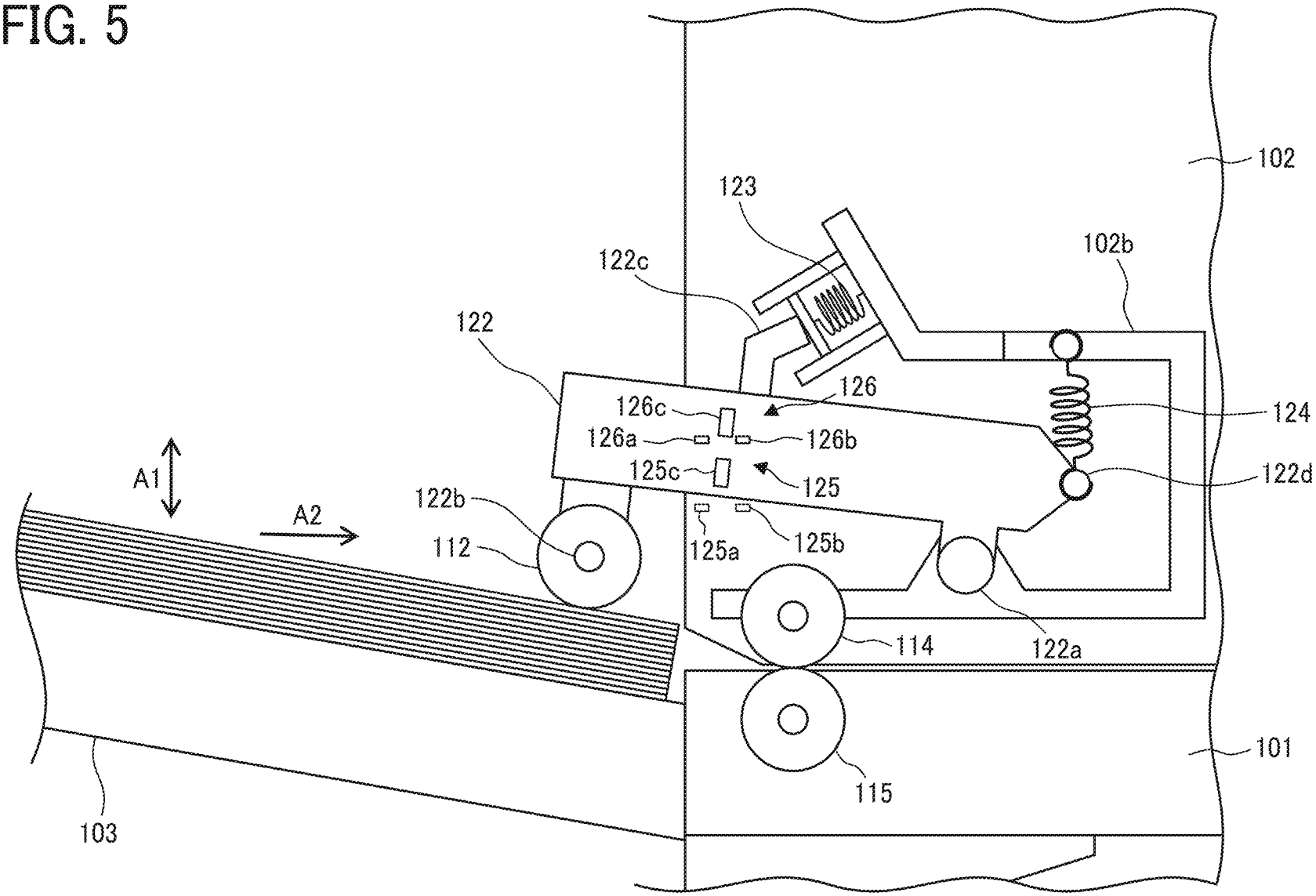
FIG. 5 is yet another schematic diagram illustrating the pick roller and the surrounding components of FIG. 3.

FIGS. 3, 4, and 5 are schematic diagrams each illustrating the pick roller 112 and surrounding components in the media feeding apparatus 100.

As illustrated in FIGS. 3, 4, and 5, the media feeding apparatus 100 further includes, for example, an arm 122, a first pressing member 123, a second pressing member 124, a first pick-roller sensor 125, and a second pick-roller sensor 126.

The arm 122 extends in the media conveyance direction A2 and is rotatable (swingable) about a shaft 122*a* in the second housing 102. The pick roller 112 is attached to an upstream end 122*b* of the arm 122. The arm 122 is swingable about the shaft 122*a*, and thus the pick roller 112 is movable (swingable) in the height direction A1, that is, up and down, about the shaft 122*a* of the arm 122.

The first pressing member 123 is an example of a pressing member. The first pressing member 123 is an elastic member such as a compression coil spring, a torsion coil spring, a plate spring, or rubber. The first pressing member 123 is disposed above the arm 122 and generates an elastic force downward. One end of the first pressing member 123 is fixed to a frame 102*b* fixed to the second housing 102, whereas the other end of the first pressing member 123 faces a projection 122*c* fixed to the upper end of the arm 122. The first pressing member 123 presses the projection 122*c* downward when the other end of the first pressing member 123 contacts the projection 122*c*. Such a configuration allows the first pressing member 123 to apply a first pressing force that is directed downward to the pick roller 112. The first pressing force is an example of a pressing force. The media feeding apparatus 100 can stably apply the first pressing force to the pick roller 112 at low cost with an elastic member as the first pressing member 123.

The second pressing member 124 is an elastic member such as a tension coil spring. The second pressing member 124 is disposed above a downstream end 122*d* of the arm 122 and generates an elastic force upward. One end of the second pressing member 124 is fixed to the frame 102*b*, whereas the other end of the second pressing member 124 is attached to the downstream end 122*d* of the arm 122. The second pressing member 124 pulls the downstream end 122*d* of the arm 122 upward to apply a second pressing force that is directed downward to the pick roller 112 attached to the upstream end 122*b* of the arm 122.

Instead of a tension coil spring, for example, a compression coil spring, a torsion coil spring, a plate spring, or rubber may be used as the second pressing member 124. In this case, the second pressing member 124 is disposed above the upstream end 122*b* of the arm 122 to generate an elastic force downward. In this case, the second pressing member 124 presses the upstream end 122*b* of the arm 122 downward to apply the second pressing force that is directed downward to the pick roller 112 attached to the upstream end 122*b* of the arm 122. The second pressing member 124 may be omitted so that the weight of the arm 122 simply directs the arm 122 downward.

When the second pressing member 124 applies the second pressing force to the pick roller 112 that is not in contact with the medium placed on the media table 103 as illustrated in FIG. 3, the pick roller 112 is locked by a stopper and is arranged at the lowermost initial position. When the pick roller 112 is at the initial position, the first pressing member 123 is not in contact with the projection 122*c* and does not apply the first pressing force to the pick roller 112.

By contrast, as illustrated in FIG. 4, when the media table 103 is raised, the pick roller 112 contacts the medium placed on the media table 103. The pick roller 112 is pushed up by the media placed on the media table 103 and raised to a first position higher than the initial position. When the pick roller 112 is at the first position, the pick roller 112 presses the medium placed on the media table 103 downward by the second pressing force of the second pressing member 124 and/or the weight of the pick roller 112. As a result, an appropriate frictional force is generated between the pick roller 112 and the medium and allows the pick roller 112 to feed the medium as appropriate. When the pick roller 112 is at the first position, the first pressing member 123 is not in contact with the projection 122*c* and does not apply the first pressing force to the pick roller 112.

As illustrated in FIG. 5, when the media table 103 is further raised from the position illustrated in FIG. 4, the pick roller 112 is further pushed up by the medium placed on the media table 103 and raised to a second position higher than the first position. When the pick roller 112 is at the second position, the pick roller 112 presses the medium placed on the media table 103 downward by the second pressing force of the second pressing member 124 and/or the weight of the pick roller 112, like when the pick roller 112 is at the first position. In other words, the second pressing member 124 applies the second pressing force to the pick roller 112 when the pick roller 112 is at the first position or the second position. As a result, an appropriate frictional force is generated between the pick roller 112 and the medium and allows the pick roller 112 to feed the medium as appropriate. When the pick roller 112 is at the second position, the first pressing member 123 is in contact with the projection 122*c* and applies the first pressing force to the pick roller 112 through the projection 122*c*. As a result, a greater frictional force is generated between the pick roller 112 and the medium and allows the pick roller 112 to feed the medium with greater force.

The first pick-roller sensor 125 and the second pick-roller sensor 126 are examples of sensors for detecting the position of the pick roller 112.

The first pick-roller sensor 125 includes a first light emitter 125*a* and a first light receiver 125*b*, which are fixed on the second housing 102 and face each other. The first light emitter 125*a* is, for example, an LED and emits light toward the first light receiver 125*b*. By contrast, the first light receiver 125*b* is, for example, a photodiode and receives light emitted by the first light emitter 125*a*. The arm 122 has a side provided with a first shield 125*c*. When the pick roller 112 is at the initial position, the first shield 125*c* is positioned between the first light emitter 125*a* and the first light receiver 125*b* as illustrated in FIG. 3. By contrast, when the pick roller 112 is at the first position or the second position, that is, when the pick roller 112 is not at the initial position, the first shield 125*c* is not positioned between the first light emitter 125*a* and the first light receiver 125*b* as illustrated in FIGS. 4 and 5. Based on the intensity of the light received by the first light receiver 125*b*, the first pick-roller sensor 125 generates and outputs a first pick-roller signal whose signal value changes depending on whether the pick roller 112 is at the initial position.

The second pick-roller sensor 126 includes a second light emitter 126*a* and a second light receiver 126*b*, which are fixed on the second housing 102 and face each other. The second light emitter 126*a* is, for example, an LED and emits light toward the second light receiver 126*b*. By contrast, the second light receiver 126*b* is, for example, a photodiode and receives light emitted by the second light emitter 126*a*. The arm 122 has the side provided with a second shield 126*c*. When the pick roller 112 is at the initial position or the first position, that is, when the pick roller 112 is not at the second position, the second shield 126*c* is positioned between the second light emitter 126*a* and the second light receiver 126*b* as illustrated in FIGS. 3 and 4. By contrast, when the pick roller 112 is at the second position, the second shield 126*c* is not positioned between the second light emitter 126*a* and the second light receiver 126*b* as illustrated in FIG. 5. Based on the intensity of the light received by the second light receiver 126*b*, the second pick-roller sensor 126 generates and outputs a second pick-roller signal whose signal value changes depending on whether the pick roller 112 is at the second position.

Alternatively, the first light emitter 125*a* and the first light receiver 125*b*, and/or the second light emitter 126*a* and the second light receiver 126*b* may be disposed on the side of the arm 122 whereas the first shield 125*c* and the second shield 126*c* may be fixed on the second housing 102.

Figure 6:
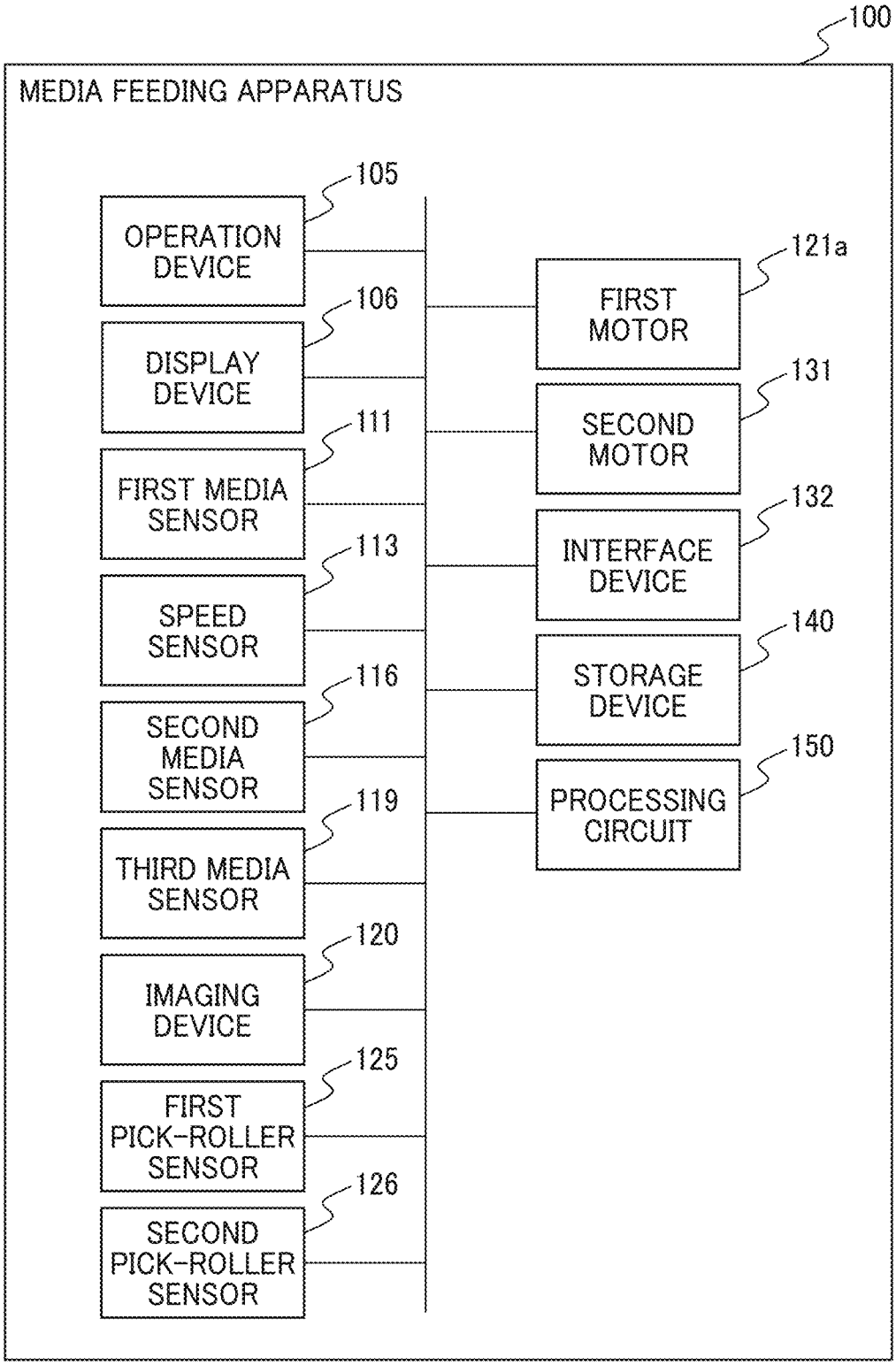
FIG. 6 is a schematic block diagram illustrating a configuration of the media feeding apparatus of FIG. 1.

FIG. 6 is a schematic block diagram illustrating a configuration of the media feeding apparatus 100.

The media feeding apparatus 100 further includes, for example, a second motor 131, an interface device 132, a storage device 140, and a processing circuit 150, in addition to the configuration described above.

The second motor 131 includes one or more motors. The second motor 131 rotates the pick roller 112, the feed roller 114, the separation roller 115, and the first to sixth conveyance rollers 117*a* to 117*e* in response to control signals from the processing circuit 150 to feed and convey media. In the following description, a motor for rotating the feeding roller 114 among the motors included in the second motor 131 may be referred to as a feeding motor. The first to sixth driven rollers 118*a* to 118*f* may be rotated by the driving force from the second motor 131, instead of rotating in accordance with the rotation of the first to sixth conveyance rollers 117*a* to 117*f*.

The interface device 132 includes an interface circuit compatible with a serial bus such as a universal serial bus (USB) and is electrically connected to an information processing device (for example, a personal computer or a mobile information processing terminal) to transmit and receive an input image and various kinds of information to and from the information processing device. The interface device 132 may be substituted by a communication unit including an antenna to transmit and receive radio signals and a wireless communication interface circuit to transmit and receive the signals through a wireless communication line according to a predetermined communication protocol. The predetermined communication protocol is, for example, a wireless local area network (LAN) communication protocol. The communication unit may include a wired communication interface circuit to transmit and receive signals through a wired communication line according to, for example, a wired LAN communication protocol.

The storage device 140 includes memories such as a random-access memory (RAM) and a read-only memory (ROM); a fixed disk device such as a hard disk; or a portable memory such as a flexible disk or an optical disk. The storage device 140 stores, for example, computer programs, databases, and tables used for various processes performed by the media feeding apparatus 100. The computer programs may be installed in the storage device 140 using, for example, a known setup program from a computer-readable portable recording medium. The portable recording medium is, for example, a compact disc read-only memory (CD-ROM) or a digital versatile disc read-only memory (DVD-ROM). The computer programs may be distributed from, for example, a server and installed in the storage device 140.

The processing circuit 150 operates according to a program prestored in the storage device 140. The processing circuit 150 is, for example, a central processing unit (CPU). Alternatively, for example, a digital signal processor (DSP), a large-scale integration (LSI), an application-specific integrated circuit (ASIC), or a field-programmable gate array (FPGA) may be used as the processing circuit 150.

The processing circuit 150 is connected to, for example, the operation device 105, the display device 106, the first media sensor 111, the speed sensor 113, the second media sensor 116, the third media sensor 119, the imaging device 120, the first pick-roller sensor 125, the second pick-roller sensor 126, the first motor 121*a*, the second motor 131, the interface device 132, and the storage device 140, and controls these components. The processing circuit 150 controls, for example, the driving of the first motor 121*a* and the second motor 131, and the imaging by the imaging device 120, based on the signals received from the sensors described above. The processing circuit 150 acquires an input image from the imaging device 120 and transmits the input image to the information processing device via the interface device 132.

Figure 7:
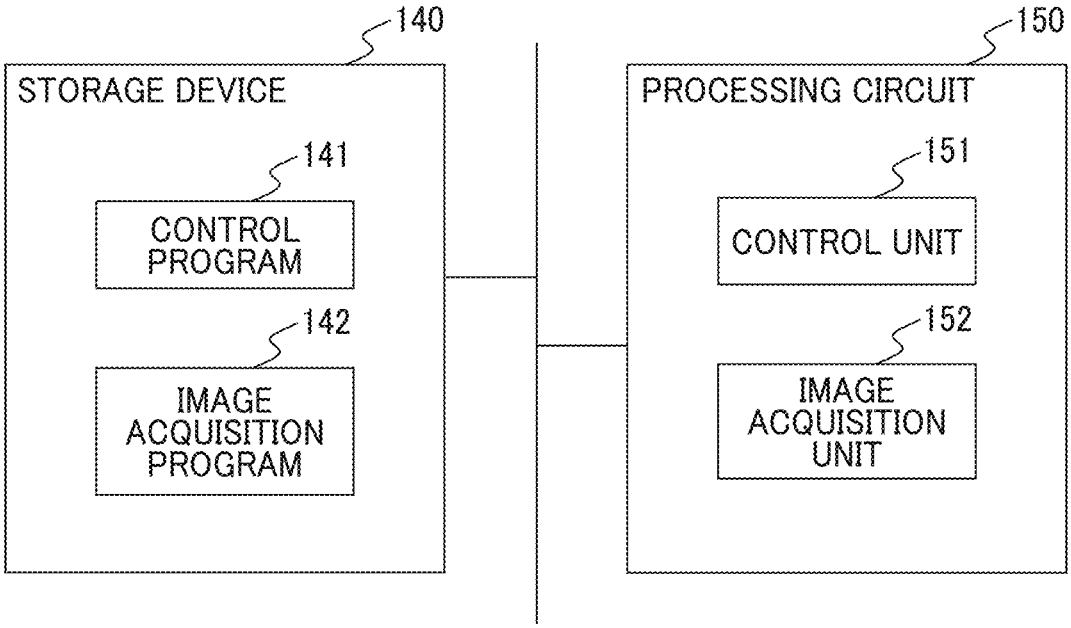
FIG. 7 is a schematic block diagram illustrating a configuration of a storage device and a processing circuit included in the media feeding apparatus of FIG. 1.

FIG. 7 is a schematic block diagram illustrating a configuration of the storage device 140 and the processing circuit 150.

As illustrated in FIG. 7, the storage device 140 stores, for example, a control program 141 and an image acquisition program 142. These programs are functional modules implemented by software operating on the processor. The processing circuit 150 reads the programs from the storage device 140 and operates according to the read programs. Thus, the processing circuit 150 functions as a control unit 151 and an image acquisition unit 152.

Figure 8:
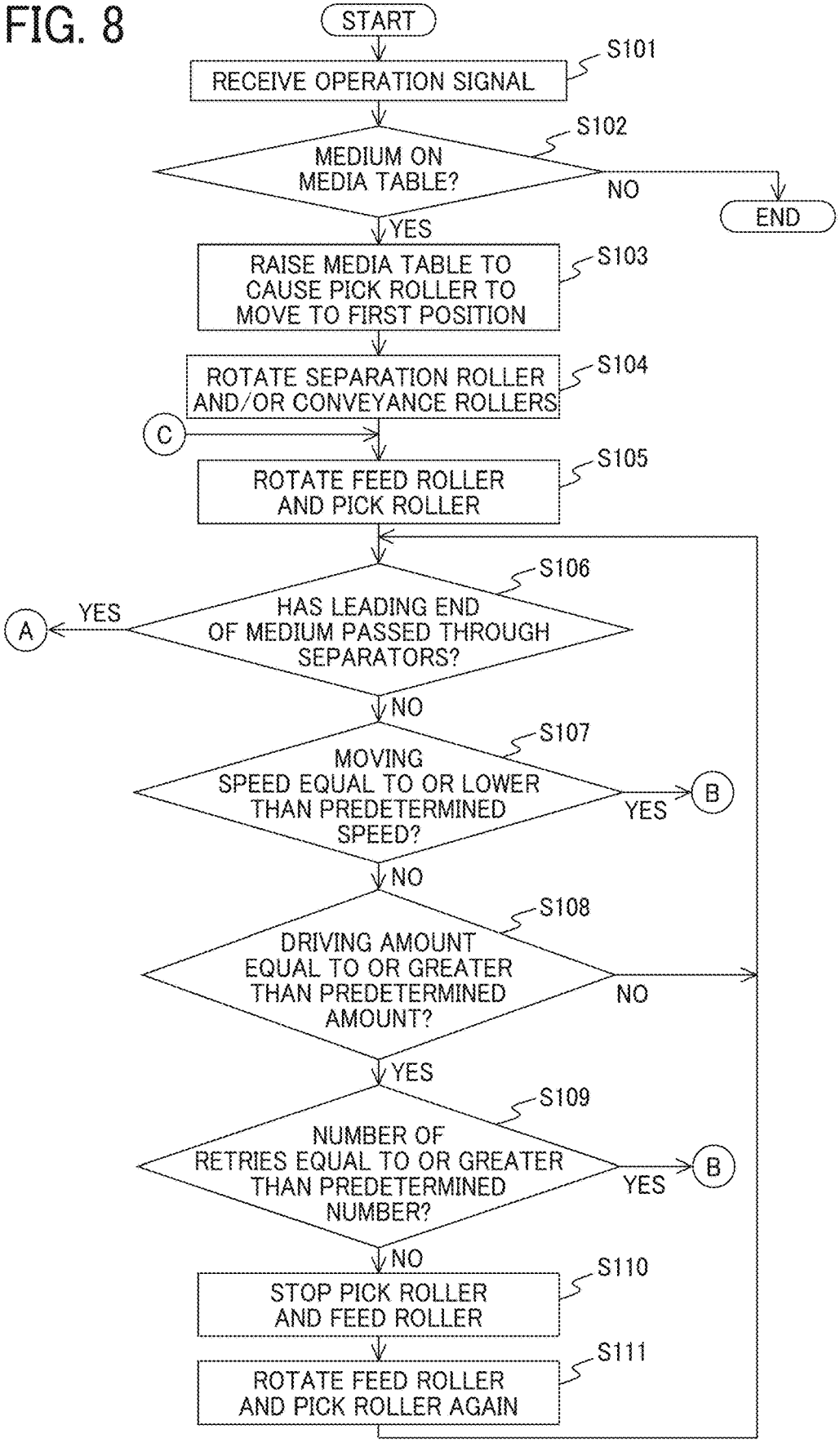
FIG. 8 is a flowchart of a media reading process.
Figure 9:
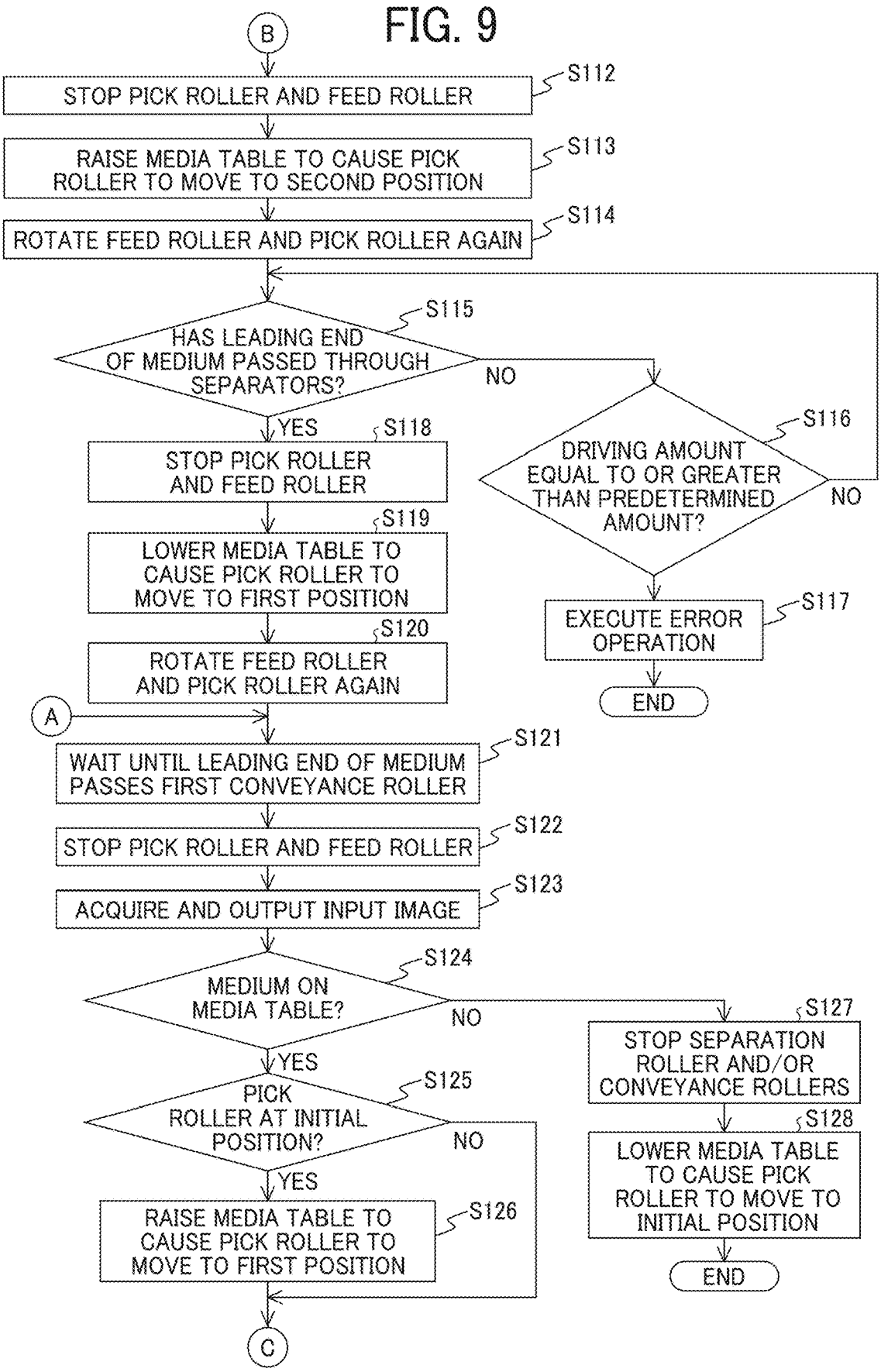
FIG. 9 is a continuation of the flowchart of FIG. 8.

FIG. 8 is a flowchart of a media reading process performed by the media feeding apparatus 100. FIG. 9 is a continuation of the flowchart of FIG. 8.

A description is given below of the media reading process performed by the media feeding apparatus 100, with reference to the flowchart of FIGS. 8 and 9. The operation process described below is executed, for example, by the processing circuit 150 in cooperation with the components of the media feeding apparatus 100 based on the program prestored in the storage device 140. A description is given below of a case where the feeding mode is set to the separation mode, with reference to the flowchart of FIGS. 8 and 9. The media table 103 is at the lowermost position in the movable range of the media table 103 before the operation of the flowchart is executed.

In step S101, the control unit 151 waits until the control unit 151 receives an operation signal instructing the reading of media from the operation device 105 or the interface device 132. The operation signal is output when the user inputs an instruction to read media using the operation device 105 or the information processing device.

In step S102, the control unit 151 acquires the first media signal from the first media sensor 111 and determines whether a medium is present on the media table 103 based on the acquired first media signal. When no medium is present on the media table 103 (NO in step S102), the control unit 151 ends the series of steps.

By contrast, when a medium is present on the media table 103 (YES in step S102), in step S103, the control unit 151 drives the first motor 121*a* and controls the moving assembly 121 to raise the media table 103 to cause the pick roller 112 to move to the first position. The control unit 151 rotates the first motor 121*a* in a direction to move the media table 103 upward. The control unit 151 periodically acquires the first pick-roller signal from the first pick-roller sensor 125. The control unit 151 stops driving the first motor 121*a* when the signal value of the first pick-roller signal changes from a value indicating that the pick roller 112 is at the initial position to a value indicating that the pick roller 112 is not at the initial position. Thus, the control unit 151 causes the pick roller 112 to move to the first position where the pick roller 112 can feed media.

In step S104, the control unit 151 drives the second motor 131 to rotate the separation roller 115, the first to sixth conveyance rollers 117*a* to 117*f*, and/or the first to sixth driven rollers 118*a* to 118*f*. At this time, the pick roller 112 and the feed roller 114 are not rotated yet, and thus the medium is not fed.

In step S105, the control unit 151 drives the second motor 131 to rotate the feed roller 114 and the pick roller 112 and feed the medium. The control unit 151 starts the rotation of the feed roller 114 and then starts the rotation of the pick roller 112. Accordingly, the media feeding apparatus 100 can prevent the medium from being jammed due to the medium being bent between the pick roller 112 and the feeding roller 114 as a result of the pick roller 112 starting to rotate before the feeding roller 114.

In step S106, the control unit 151 determines whether the leading end of the medium has passed through the separators. The control unit 151 periodically acquires the second media signal from the second media sensor 116 and determines that the second media sensor 116 has detected the leading end of the medium when the signal value of the second media signal changes from a value indicating the absence of a medium to a value indicating the presence of a medium. When the second media sensor 116 detects the leading end of the medium, the control unit 151 determines that the leading end of the medium has passed through the separators. When the leading end of the medium has passed through the separators (YES in step S106), the control unit 151 proceeds to step S121.

By contrast, when the leading end of the medium has not passed through the separators yet (NO in step S106), in step S107, the control unit 151 determines whether the moving speed of the medium during feeding is equal to or lower than a predetermined speed. The control unit 151 acquires the speed signal from the speed sensor 113 and determines whether the moving speed indicated by the speed signal is equal to or lower than the predetermined speed. Thus, the control unit 151 determines whether the moving speed of the medium during feeding is equal to or lower than the predetermined speed. The predetermined speed is preset to, for example, the minimum value of the moving speed when media are properly fed in preliminary experiments in which various types of media are fed. When the moving speed of the medium during feeding is equal to or lower than the predetermined speed (YES in step S107), the control unit 151 proceeds to step S112.

By contrast, when the moving speed of the medium during feeding is higher than the predetermined speed (NO in step S107), in step S108, the control unit 151 determines whether the driving amount by which the feeding motor is driven is equal to or greater than a predetermined amount. The predetermined amount is preset to, for example, the maximum value of the driving amount by which the feeding motor is driven until media pass through the separators when the media are properly fed in preliminary experiments in which various types of media are fed. When the driving amount by which the feeding motor is driven is less than the predetermined amount yet (NO in step S108), the control unit 151 returns to step S106 and repeats the operations from step S106 onward.

By contrast, when the driving amount by which the feeding motor is driven is equal to or greater than the predetermined amount (YES in step S108), the control unit 151 determines that the medium has failed to be fed. In step S109, the control unit 151 determines whether the number of retries of feeding the medium, which is the number of times of feeding the medium again, is equal to or greater than a predetermined number. The feeding of the medium is retried by temporarily stopping and rotating the pick roller 112 and the feeding roller 114 again. The predetermined number is preset to a number equal to or greater than 0 (for example, 1 or 2). When the number of retries of feeding the medium is equal to or greater than the predetermined number (YES in step S109), the control unit 151 determines that the leading end of the medium has not reached a predetermined position within a predetermined time from the start of feeding the medium. The control unit 151 then proceeds to step S112. The predetermined time is a time obtained by multiplying a time required for driving the feeding motor by a predetermined amount by the number of times of driving the feeding motor by the predetermined amount. The predetermined position is the position of the second media sensor 116.

By contrast, when the number of retries of feeding the medium is still less than the predetermined number (NO in step S109), in step S110, the control unit 151 controls the second motor 131 to temporarily stop the rotation of the pick roller 112 and the feed roller 114. The control unit 151 stops the rotation of the pick roller 112 and then stops the rotation of the feed roller 114. Accordingly, the media feeding apparatus 100 can prevent the medium from being jammed due to the medium being bent between the pick roller 112 and the feed roller 114 as a result of the feed roller 114 stopping before the pick roller 112.

In step S111, the control unit 151 drives the second motor 131 to rotate the feed roller 114 and the pick roller 112 again and feed the medium again. The control unit 151 starts the rotation of the feed roller 114 and then starts the rotation of the pick roller 112, as in the operation in step S105. The control unit 151 then returns to step S106 and repeats the operations from step S106 onward.

When the moving speed of the medium during feeding is equal to or lower than the predetermined speed (YES in step S107), or when the leading end of the medium has not reached the predetermined position within the predetermined time from the start of feeding the medium (YES in step S109), in step S112, the control unit 151 controls the second motor 131 to temporarily stop the rotation of the pick roller 112 and the feed roller 114. The control unit 151 stops the rotation of the pick roller 112 and then stops the rotation of the feed roller 114, as in the operation in step S110.

In step S113, the control unit 151 drives the first motor 121*a* and controls the moving assembly 121 to further raise the media table 103 to cause the pick roller 112 to move to the second position. The control unit 151 rotates the first motor 121*a* in the direction to move the media table 103 upward. The control unit 151 periodically acquires the second pick-roller signal from the second pick-roller sensor 126. The control unit 151 stops driving the first motor 121*a* when the signal value of the second pick-roller signal changes from a value indicating that the pick roller 112 is not at the second position to a value indicating that the pick roller 112 is at the second position. Thus, the control unit 151 causes the pick roller 112 to move to the second position higher than the first position.

As described above, when the leading end of the medium does not reach the predetermined position within the predetermined time from the start of feeding the medium, or when the moving speed of the medium during feeding is equal to or lower than the predetermined speed, the control unit 151 controls the media table 103 to be raised to press the media placed on the media table 103 toward the pick roller 112. When the pick roller 112 is at the second position by the media table 103 raised, the first pressing member 123 applies the pressing force to the pick roller 112. As a result, a greater frictional force is generated between the pick roller 112 and the medium and allows the media feeding apparatus 100 to feed the medium, which has failed to be fed, again with greater force.

The control unit 151 detects, with the second pick-roller sensor 126, that the pick roller 112 has moved to the second position or a position higher than the second position. The control unit 151 stops the movement of the media table 103 when the pick roller 112 is at the second position or the position higher than the second position. The position higher than the second position is an example of a third position. With the second pick-roller sensor 126, the media feeding apparatus 100 can determine with high accuracy whether the first pressing force that is directed downward is applied to the pick roller 112 by the first pressing member 123. Accordingly, when the pick roller 112 fails to feed a medium, the media feeding apparatus 100 reliably applies the first pressing force to the pick roller 112 to increase the possibility of successfully feeding the medium again.

In step S114, the control unit 151 drives the second motor 131 to rotate the feed roller 114 and the pick roller 112 again and feed the medium again, as in the operation in step S111.

In step S115, the control unit 151 determines whether the leading end of the medium has passed through the separators, as in the operation in step S106.

When the leading end of the medium has not passed through the separators yet (NO in step S115), in step S116, the control unit 151 determines whether the driving amount by which the feeding motor is driven is equal to or greater than the predetermined amount, as in the operation in step S108. When the driving amount by which the feeding motor is driven is less than the predetermined amount yet (NO in step S116), the control unit 151 returns to step S115 and repeats the operations from step S115 onward.

By contrast, when the driving amount by which the feeding motor is driven is equal to or greater than the predetermined amount (YES in step S116), the control unit 151 determines that the medium has not fed as appropriate. In step S117, the control unit 151 executes an error operation. Thus, the control unit 151 ends the series of steps. As the error operation, the control unit 151 controls the second motor 131 to stop the rotation of the pick roller 112, the feed roller 114, the separation roller 115, the first to sixth conveyance rollers 117*a* to 117*f*, and/or the first to sixth driven rollers 118*a* to 118*f*. As the error operation, the control unit 151 also drives the first motor 121*a* and controls the moving assembly 121 to lower the media table 103 to the lowermost position in the movable range of the media table 103 to cause the pick roller 112 to move to the initial position. As the error operation, the control unit 151 may also notify the user of information indicating that the medium has not fed as appropriate by displaying the information on the display device 106 or transmitting the information to the information processing apparatus via the interface device 132.

By contrast, when the leading end of the medium has passed through the separators (YES in step S115), in step S118, the control unit 151 controls the second motor 131 to temporarily stop the rotation of the pick roller 112 and the feed roller 114, as in the operation in step S110.

In step S119, the control unit 151 drives the first motor 121*a* and controls the moving assembly 121 to lower the media table 103 to cause the pick roller 112 to move to the first position. The control unit 151 rotates the first motor 121*a* in a direction to move the media table 103 downward. The control unit 151 periodically acquires the first pick-roller signal from the first pick-roller sensor 125. The control unit 151 temporarily stops driving the first motor 121*a* when the signal value of the first pick-roller signal changes from a value indicating that the pick roller 112 is not at the initial position to a value indicating that the pick roller 112 is at the initial position. The control unit 151 rotates the first motor 121*a* in the direction to move the media table 103 upward. The control unit 151 periodically acquires the first pick-roller signal from the first pick-roller sensor 125. The control unit 151 stops the rotation of the first motor 121*a* when the signal value of the first pick-roller signal changes from a value indicating that the pick roller 112 is at the initial position to a value indicating that the pick roller 112 is not at the initial position. Thus, the control unit 151 repositions the pick roller 112 at the first position.

In step S120, the control unit 151 drives the second motor 131 to rotate the feed roller 114 and the pick roller 112 again and feed the medium again, as in the operation in step S111.

In step S121, the control unit 151 waits until the leading end of the medium passes the position of the first conveyance roller 117*a*. The control unit 151 periodically acquires the third media signal from the third media sensor 119 and determines that the third media sensor 119 has detected the leading end of the medium when the signal value of the third media signal changes from a value indicating the absence of a medium to a value indicating the presence of a medium. The control unit 151 determines that the leading end of the medium has passed the position of the first conveyance roller 117*a* when the third media sensor 119 detects the leading end of the medium.

In step S122, the control unit 151 controls the second motor 131 to stop the rotation of the pick roller 112 and the feed roller 114, as in the operation in step S110. Thereafter, the medium is conveyed by the first conveyance roller 117*a* and the first driven roller 118*a*.

In step S123, the image acquisition unit 152 acquires an input image from the imaging device 120 and transmits (i.e., outputs) the acquired input image to the information processing device via the interface device 132. The image acquisition unit 152 causes the imaging device 120 to start imaging before the leading end of the medium reaches the imaging position in the imaging device 120, for example, at the time when the third media sensor 119 detects the leading end of the medium. The image acquisition unit 152 causes the imaging device 120 to finish imaging after the trailing end of the medium passes the imaging position in the imaging device 120, for example, at the time when a predetermined time has elapsed after the detection of the trailing end of the medium by the third media sensor 119. The image acquisition unit 152 then acquires the input image from the imaging device 120. The image acquisition unit 152 periodically acquires the third media signal from the third media sensor 119 and determines that the third media sensor 119 has detected the trailing end of the medium when the signal value of the third media signal changes from a value indicating the presence of a medium to a value indicating the absence of a medium. The predetermined time is set to a time obtained by adding a margin to a time taken for media to move from the third media sensor 119 to the imaging position.

In step S124, the control unit 151 determines whether a medium remains on the media table 103 based on the first media signal received from the first media sensor 111.

When a medium remains on the media table 103 (YES in step S124), in step S125, the control unit 151 determines whether the pick roller 112 is at the initial position. The control unit 151 acquires the first pick-roller signal from the first pick-roller sensor 125 and determines whether the pick roller 112 is at the initial position based on the acquired first pick-roller signal. When the pick roller 112 is not at the initial position (NO in step S125), that is, when the pick roller 112 is at the first position, the control unit 151 returns to step S105 and repeats the operations from step S105 onward.

By contrast, when the pick roller 112 is at the initial position (YES in step S125), that is, when the pick roller 112 is not at the first position, in step S126, the control unit 151 causes the pick roller 112 to move to the first position, as in the operation in step S103. The control unit 151 then returns to step S105 and repeats the operations from step S105 onward.

By contrast, when no medium remains on the media table 103 (NO in step S124), in step S127, the control unit 151 controls the second motor 131 to stop the rotation of the separation roller 115, the first to sixth conveyance rollers 117*a* to 117*f*, and/or the first to sixth driven rollers 118*a* to 118*f*.

In step S128, the control unit 151 drives the first motor 121*a* and controls the moving assembly 121 to lower the media table 103 to the lowermost position in the movable range of the media table 103 to cause the pick roller 112 to move to the initial position. Thus, the control unit 151 ends the series of steps.

The operation in step S107 or the operations in steps S109 to S111 may be omitted. When the operations in steps S109 to S111 are omitted and the number of retries of feeding the medium is equal to or greater than the predetermined number (YES in step S109), the control unit 151 executes the error operation in step S117. When the driving amount by which the feeding motor is driven is equal to or greater than the predetermined amount (YES in step S116), the control unit 151 may retry feeding the medium, that is, that control unit 151 may feed the medium again, as in the operations in steps S109 to S111.

Figure 10:
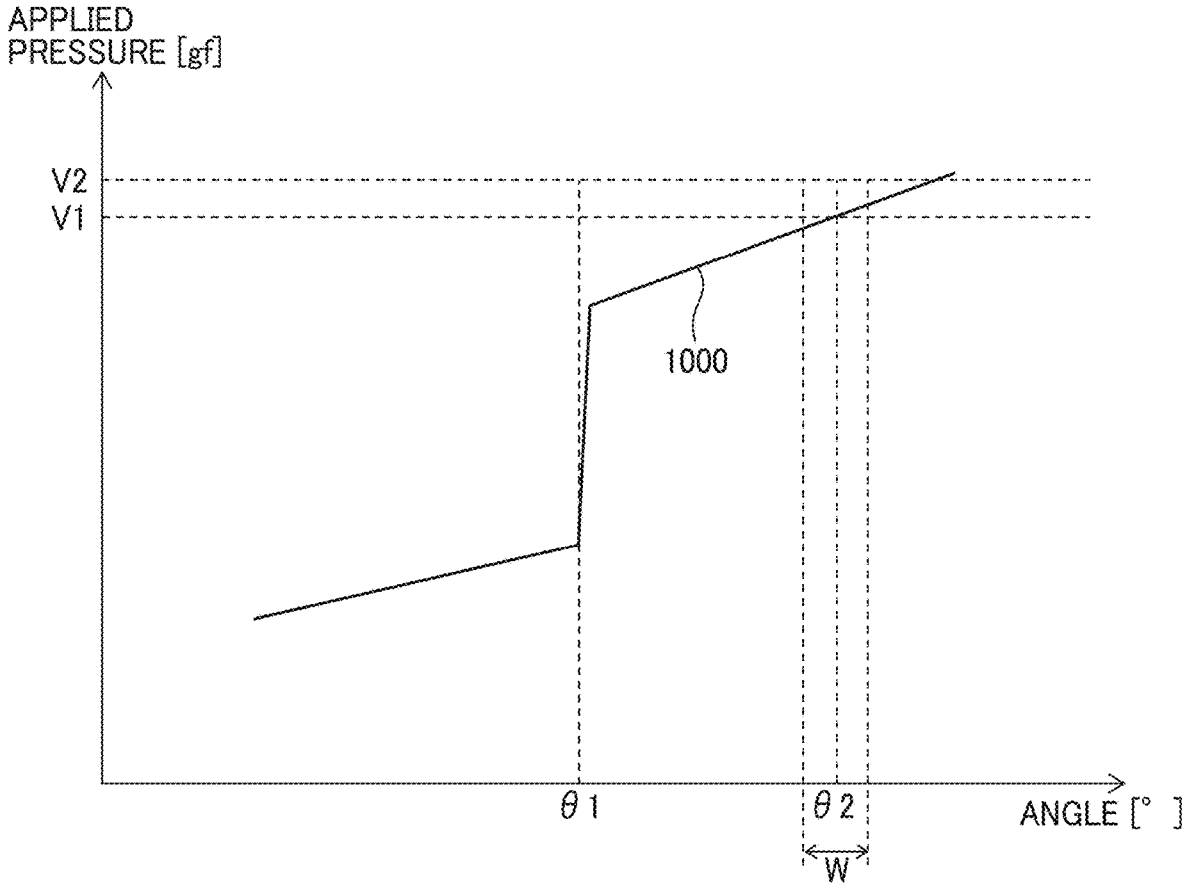
FIG. 10 is a graph illustrating the relationship between the angle of an arm and the applied pressure.

FIG. 10 is a graph 1000 illustrating the relationship between the angle of the arm 122 with respect to the table face of the media table 103 and the pressure applied to the pick roller 112, that is, the relationship between the position of the pick roller 112 and the pressure applied to the pick roller 112.

In FIG. 10, the horizontal axis indicates the angle [°] of the arm 122 with respect to the table face of the media table 103, whereas the vertical axis indicates the pressure [gf] applied to the pick roller 112. As the angle of the arm 122 increases, the pick roller 112 is positioned higher. An angle θ1 is an angle by which the projection 122*c* of the arm 122 changes from a state where the projection 122*c* is not in contact with the first pressing member 123 to a state where the projection 122*c* is in contact with the first pressing member 123. In other words, the angle θ1 is an angle between the angle of the arm 122 when the pick roller 112 is at the first position and the angle of the arm 122 when the pick roller 112 is at the second position. An angle θ2 is an angle of the arm 122 when the pick roller 112 is at the second position.

As illustrated in FIG. 10, when the angle of the arm 122 is less than the angle θ1, that is, when the pick roller 112 is at the first position, the pressing force is applied to the pick roller 112 simply by the second pressing member 124. When feeding media such as plain paper copy (PPC) sheets, the media feeding apparatus 100 does not press the media against the pick roller 112 with extreme force, and thus the media feeding apparatus 100 can prevent jamming or multiple feeding of the media.

Further, by adjusting the pressure applied to the pick roller 112 with the second pressing member 124, the media feeding apparatus 100 can easily change the characteristics of the second pressing member 124 for each user. The user can customize the second pressing member 124 according to, for example, the use of the media feeding apparatus 100 or the type of media to be fed. For example, when only thin paper is fed, the user can reduce the pressing force applied to the pick roller 112 with the second pressing member 124 to appropriately limit the pressing force applied to the thin paper by the pick roller 112. Accordingly, the media feeding apparatus 100 can enhance the convenience for the user.

However, when the pick roller 112 presses a medium such as glossy paper with small force, the medium may slip because of a small frictional force generated between the medium and the pick roller 112. As a result, the pick roller 112 may fail to feed the medium. When the pick roller 112 fails to feed a medium, the media feeding apparatus 100 raises the pick roller 112 to the second position. As illustrated in FIG. 10, when the angle of the arm 122 is the angle θ2, that is, when the pick roller 112 is at the second position, the pressing force is applied to the pick roller 112 by the first pressing member 123 in addition to the second pressing member 124. Accordingly, when the pick roller 112 fails to feed a medium because of a small frictional force generated between the medium and the pick roller 112, the media feeding apparatus 100 increases the pressing force applied by the pick roller 112 to the medium and retries to feed the medium as appropriate.

The spring constant of the first pressing member 123 is preferably equal to or less than a predetermined value. In FIG. 10, an applied pressure V1 allows glossy paper to be fed as appropriate whereas an applied pressure V2 tends to cause jamming of media. As illustrated in FIG. 10, the applied pressure V2 is greater than the applied pressure V1 while being approximate to the applied pressure V1. Since the spring constant of the first pressing member 123 is small, the inclination of the graph 1000 is sufficiently small when the angle of the arm 122 is greater than the angle θ1. For this reason, even if the angle of the arm 122 is greater than the angle θ2 due to individual differences in the components such as the pick roller 112, the arm 122, and the first pressing member 123 or in the positions of such components, the pressure applied to the pick roller 112 is unlikely to be equal to or greater than the applied pressure V2. Accordingly, the media feeding apparatus 100 can prevent media from being jammed due to the deviation of the pick roller 112 from the second position caused by individual differences in such components or in the positions of such components.

The position of the projection 122*c* that contacts the first pressing member 123 on the arm 122 is preferably upstream from the shaft 122*a*, which is the fulcrum of the arm 122, by a predetermined distance or more in the media conveyance direction A2. When the position to which the first pressing force is applied on the arm 122 is apart from the fulcrum of the arm 122, that is, from the position of the center of gravity of the arm 122, the ratio of the amount of fluctuation of the first pressing force applied to the pick roller 112 to the amount of movement of the arm 122 is reduced. Accordingly, the media feeding apparatus 100 can prevent media from being jammed due to the deviation of the pick roller 112 from the second position caused by individual differences in such components or in the positions of such components.

With the second pick-roller sensor 126, the media feeding apparatus 100 detects with high accuracy that the pick roller 112 has moved to the second position. Thus, the media feeding apparatus 100 can sufficiently reduce the amount of deviation (angular deviation amount W) of the pick roller 112 from the second position when the pick roller 112 is at the second position. Accordingly, the media feeding apparatus 100 can prevent media from being jammed due to the pressure applied to the pick roller 112 being equal to or greater than the applied pressure V2.

As described above in detail, the media feeding apparatus 100 raises the media table 103 when a medium fails to be fed. When the pick roller 112 is at the second position higher than the first position, the media feeding apparatus 100 applies a downward pressing force to the pick roller 112 to increase the pressing force of the pick roller 112 against media. In other words, the media feeding apparatus 100 changes the magnitude of the pressing force applied to the pick roller 112 step by step when the pick roller 112 fails to feed a medium. Accordingly, the media feeding apparatus 100 can prevent the multiple feeding of media such as PPC sheets and the slip of a medium such as glossy paper when feeding the medium. Thus, the media feeding apparatus 100 can feed a plurality of types of media as appropriate.

The media feeding apparatus 100 can reduce the frequency of the user setting a medium again and feeding the medium again as a result of the medium failing to be fed. Thus, the media feeding apparatus 100 can enhance the convenience for the user.

Figure 11:
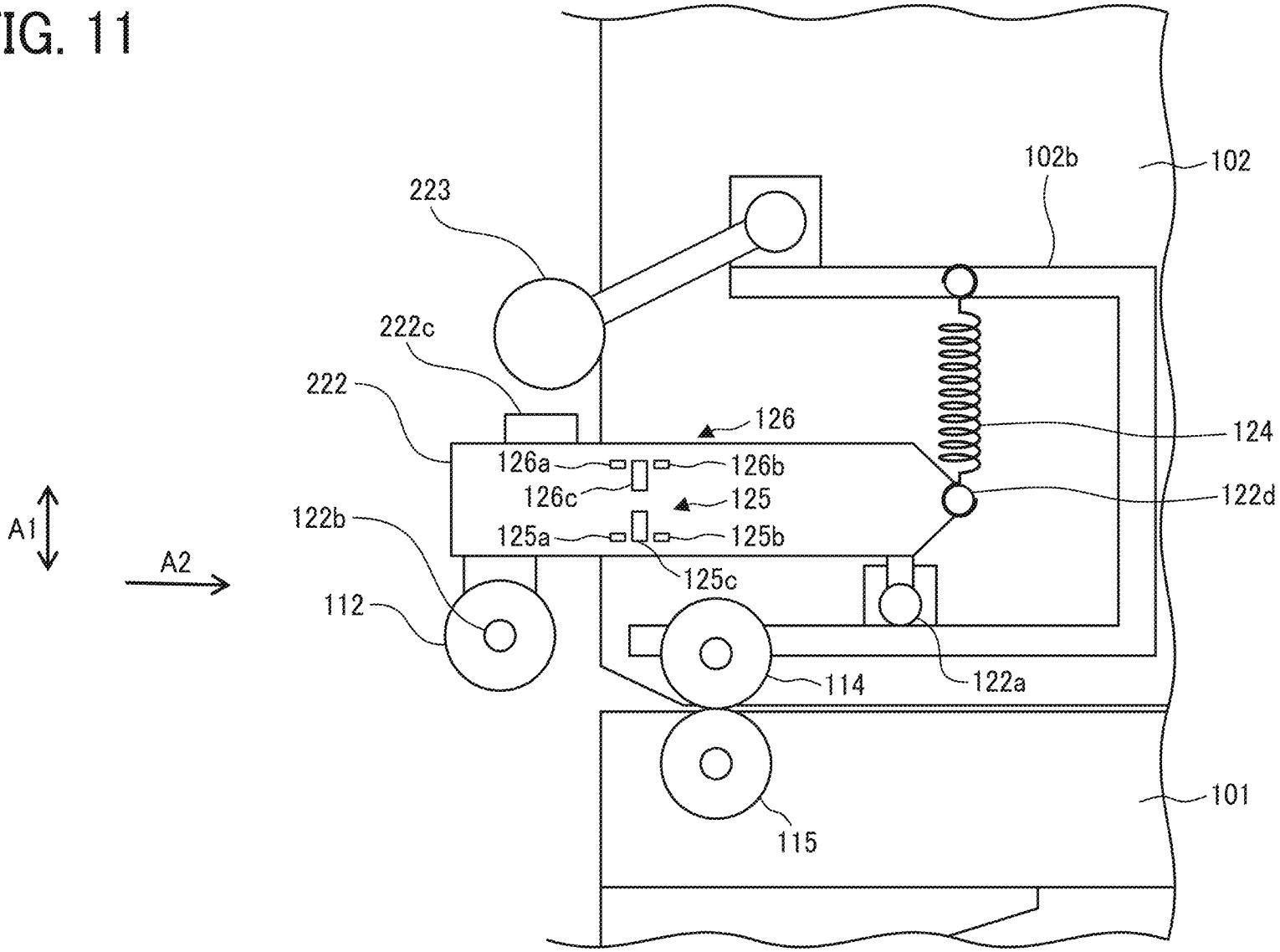
FIG. 11 is a schematic diagram illustrating a pick roller and surrounding components in a media feeding apparatus according to another embodiment of the present disclosure.
Figure 12:
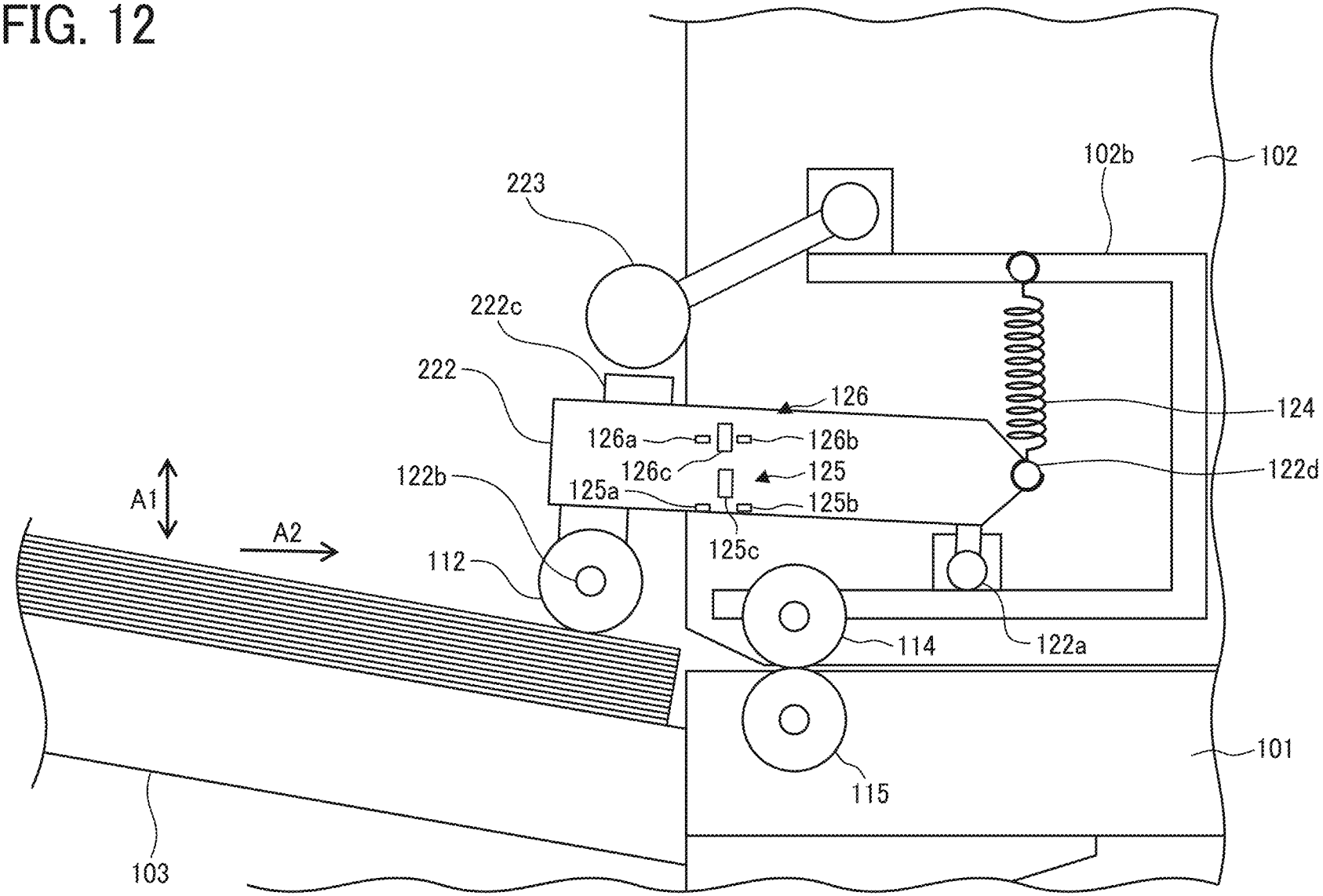
FIG. 12 is another schematic diagram illustrating the pick roller and the surrounding components of FIG. 11.
Figure 13:
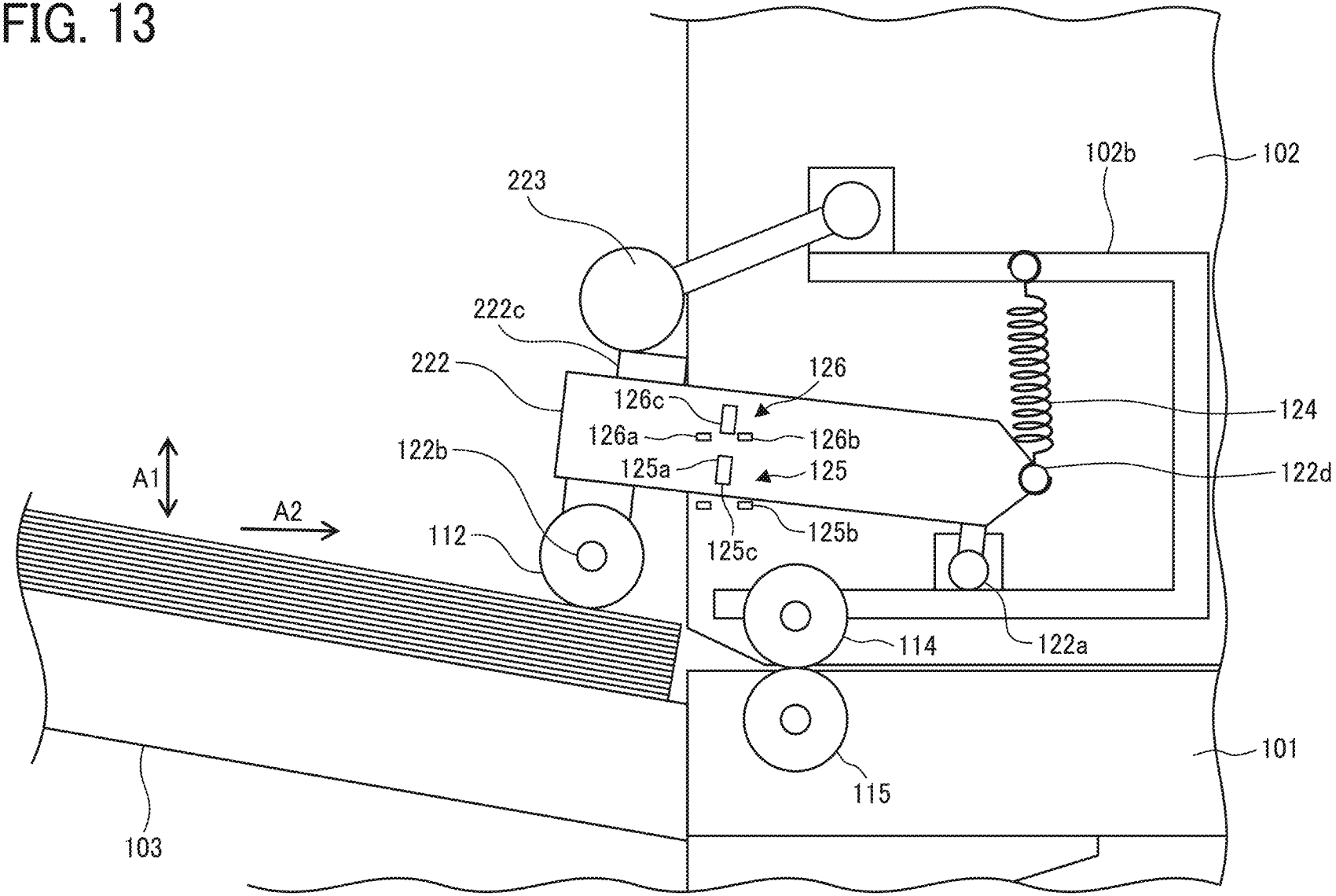
FIG. 13 is yet another schematic diagram illustrating the pick roller and the surrounding components of FIG. 11.

FIGS. 11, 12, and 13 are schematic diagrams each illustrating the pick roller 112 included in a media feeding apparatus according to another embodiment of the present disclosure.

The media feeding apparatus according to the embodiment includes an arm 222 and a first pressing member 223 instead of the arm 122 and the first pressing member 123.

The arm 222 has substantially the same configuration as the arm 122. However, the arm 222 does not include the projection 122*c*. Instead, the arm 222 includes a contact portion 222*c*. The contact portion 222*c* is disposed at the upper end of the arm 222.

The first pressing member 223 is an example of the pressing member. The first pressing member 223 is a weighting member such as a weight. The first pressing member 223 is disposed above the arm 222 and generates a downward gravitational force. The first pressing member 223 is swingably supported by the frame 102*b* to face the contact portion 222*c*. When the first pressing member 223 contacts the contact portion 222*c*, the first pressing member presses the contact portion 222*c* downward. Such a configuration allows the first pressing member 223 to apply the first pressing force that is directed downward to the pick roller 112. The media feeding apparatus can stably apply the first pressing force to the pick roller 112 at low cost with a weighting member as the first pressing member 223.

When the pick roller 112 is at the initial position as illustrated in FIG. 11, the first pressing member 223 is not in contact with the contact portion 222*c* and does not apply the first pressing force to the pick roller 112. When the pick roller 112 is at the first position as illustrated in FIG. 12, the first pressing member 223 is not in contact with the contact portion 222*c* and does not apply the first pressing force to the pick roller 112. By contrast, when the pick roller 112 is at the second position as illustrated in FIG. 13, the first pressing member 223 is in contact with the contact portion 222*c* and applies the first pressing force to the pick roller 112 through the contact portion 222*c*.

Like the media feeding apparatus 100, the media feeding apparatus according to the present embodiment executes the media reading process illustrated in FIGS. 8 and 9. The media feeding apparatus according to the present embodiment also changes the magnitude of the pressing force applied to the pick roller 112 step by step when the pick roller 112 fails to feed a medium. In particular, the media feeding apparatus including a weighting member as the first pressing member 223 is less likely to be affected by a change in the position of the media table 103. Thus, the media feeding apparatus can adjust the magnitude of the pressing force applied to the pick roller 112 with increased accuracy.

As described above in detail, the media feeding apparatus including a weighting member as the first pressing member 223 can feed a plurality of types of media as appropriate.

Figure 14:
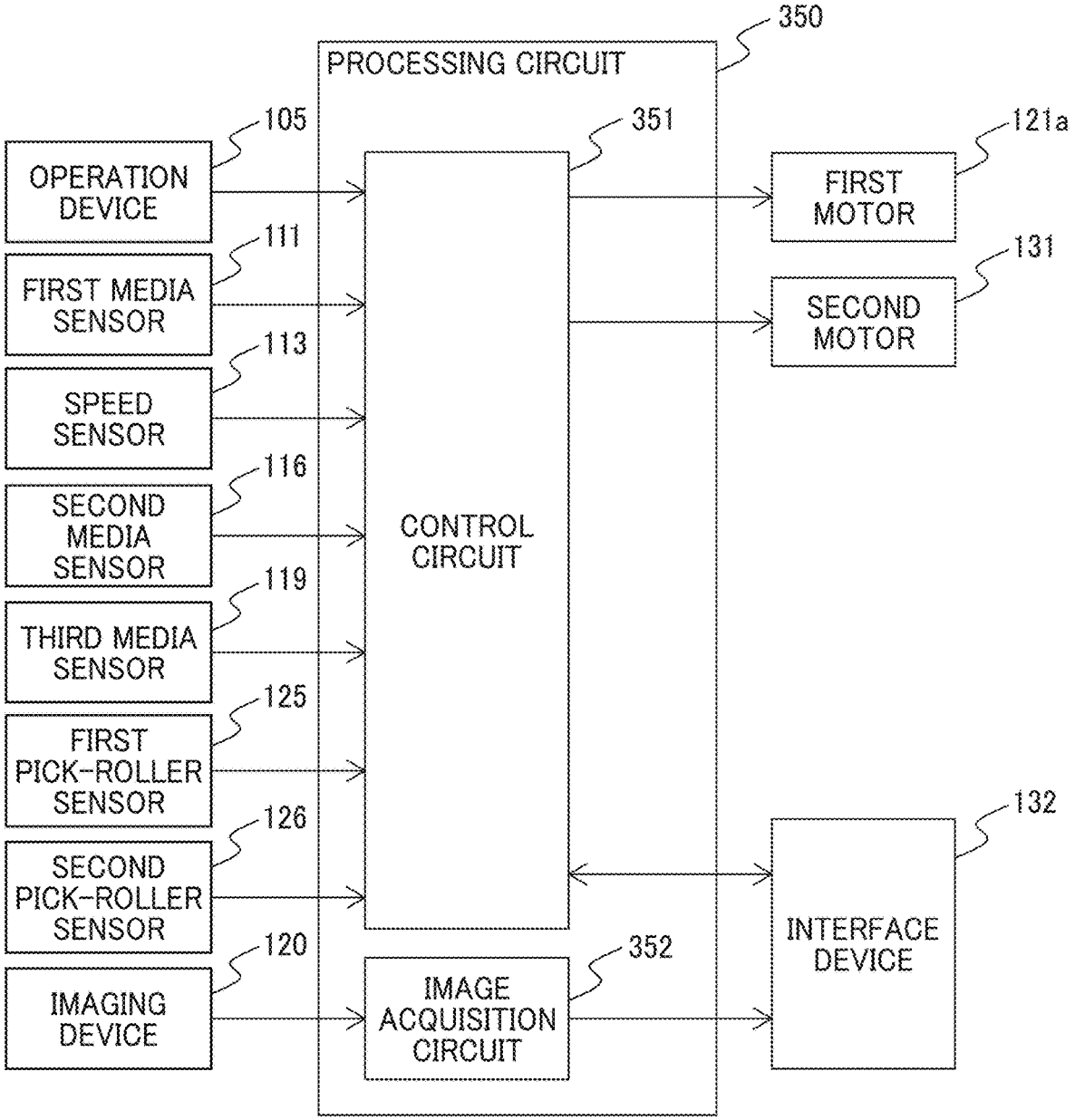
FIG. 14 is a schematic diagram illustrating a configuration of a processing circuit according to yet another embodiment of the present disclosure.

FIG. 14 is a schematic diagram illustrating a configuration of a processing circuit 350 of a media feeding apparatus according to yet another embodiment of the present disclosure.

The processing circuit 350 substitutes for the processing circuit 150 of the media feeding apparatus 100 and executes, for example, the media reading process instead of the processing circuit 150. The processing circuit 350 includes, for example, a control circuit 351 and an image acquisition circuit 352. These circuits may be, for example, independent integrated circuits, microprocessors, or firmware.

The control circuit 351 is an example of a control unit and functions like the control unit 151. The control circuit 351 receives the operation signal from the operation device 105 or the interface device 132. The control circuit 351 receives the first media signal, the speed signal, the second media signal, and the third media signal from the first media sensor 111, the speed sensor 113, the second media sensor 116, and the third media sensor 119, respectively. The control circuit 351 receives the first pick-roller signal and the second pick-roller signal from the first pick-roller sensor 125 and the second pick-roller sensor 126, respectively. The control circuit 351 controls the first motor 121*a* and the second motor 131 based on the received signals.

The image acquisition circuit 352 is an example of an image acquisition unit and functions like the image acquisition unit 152. The image acquisition circuit 352 acquires an input image from the imaging device 120 and outputs the input image to the interface device 132.

As described above in detail, the media feeding apparatus including the processing circuit 350 can feed a plurality of types of media as appropriate.

Although several embodiments of the present disclosure have been described above, the embodiments are not limited thereto. For example, the media feeding apparatus 100 may include a plurality of first pressing members 123 and change the magnitude of the pressing force applied to the pick roller 112 by three or more steps based on the position of the pick roller 112. Accordingly, the media feeding apparatus 100 can feed more types of media as appropriate.

The first pick-roller sensor 125 and the second pick-roller sensor 126 may be substituted by imaging sensors fixed to the second housing 102 to image the pick roller 112 and/or the arm 122. In this case, the imaging sensors image the pick roller 112 and/or the arm 122 and generate images to detect, by a known image processing technique, the position of the pick roller 112 and/or the arm 122 in the generated images. Based on the detected position of the pick roller 112 and/or the arm 122, the imaging sensors generate and output pick-roller signals indicating whether the pick roller 112 is at the initial position, the first position, or the second position.

In this case, the control unit 151 acquires the pick-roller signals from the imaging sensors in steps S103, S113, S119, and S125 of FIGS. 8 and 9. Based on the acquired pick-roller signals, the control unit 151 determines whether the pick roller 112 is at the initial position, the first position, or the second position.

Alternatively, the first pick-roller sensor 125 and/or the second pick-roller sensor 126 may be omitted. In this case, the control unit 151 determines whether the pick roller 112 is at the initial position, the first position, or the second position based on a driving amount by which the first motor 121*a* is driven.

According to one or more aspects of the present disclosure, the media feeding apparatus, the medium feeding method, and the control program can feed a plurality of types of media as appropriate.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

The functionality of the elements disclosed herein may be implemented using circuitry or processing circuitry which includes general purpose processors, special purpose processors, integrated circuits, ASICs ("Application Specific Integrated Circuits"), FPGAs ("Field-Programmable Gate Arrays"), and/or combinations thereof which are configured or programmed, using one or more programs stored in one or more memories, to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein which is programmed or configured to carry out the recited functionality.

There is a memory that stores a computer program which includes computer instructions. These computer instructions provide the logic and routines that enable the hardware (e.g., processing circuitry or circuitry) to perform the method disclosed herein. This computer program can be implemented in known formats as a computer-readable storage medium, a computer program product, a memory device, a record medium such as a CD-ROM or DVD, and/or the memory of a FPGA or ASIC.

The invention claimed is:

1. A media feeding apparatus, comprising:

a media table on which a medium is placed;

a pick roller, disposed above the media table, to feed the medium placed on the media table;

a first pressing member to apply a first downward pressing force to the pick roller;

a second pressing member to apply a second downward pressing force to the pick roller; and circuitry configured to control the media table to be raised to press the medium placed on the media table toward the pick roller when the medium fails to be fed, wherein the pick roller is moved from a first position to a second position when the media table is raised, the second position being higher than the first position, wherein the first pressing member does not apply the first downward pressing force to the pick roller when the pick roller is at the first position, and applies the first downward pressing force to the pick roller when the pick roller is at the second position, and wherein the second pressing member applies the second downward pressing force to the pick roller when the pick roller is at the first position or the second position.

2. The media feeding apparatus according to claim 1, wherein the first pressing member is an elastic member.

3. The media feeding apparatus according to claim 1, wherein the first pressing member is a weighting member.

4. The media feeding apparatus according to claim 1, further comprising a sensor to detect a position of the pick roller, wherein the circuitry is configured to control the media table to stop being raised when the pick roller is at the second position or a third position higher than the second position.

5. The media feeding apparatus according to claim 1, wherein the circuitry controls the media table to be raised when a leading end of the medium does not reach a predetermined position within a predetermined time from a start of feeding the medium or when a moving speed of the medium during feeding is equal to or lower than a predetermined speed.

6. A media feeding method, comprising:

feeding, by a pick roller, a medium placed on a media table;

raising the media table to press the medium placed on the media table toward the pick roller when the medium fails to be fed, the pick roller being moved from a first position to a second position when the media table is raised, the second position being higher than the first position;

not applying, by a first pressing member, a first downward pressing force to the pick roller when the pick roller is at the first position, and applying, by the first pressing member, the first downward pressing force to the pick roller when the pick roller is at the second position, and applying, by a second pressing member, a second downward pressing force to the pick roller when the pick roller is at the first position or the second position.

7. A non-transitory recording medium storing a plurality of instructions which, when executed by one or more processors, causes the one or more processors to perform a method, the method comprising:

raising a media table to press a medium placed on the media table toward a pick roller when the medium fails to be fed, the pick roller being moved from a first position to a second position when the media table is raised, the second position being higher than the first position;

not applying, by a first pressing member, a first downward pressing force to the pick roller when the pick roller is at the first position, and applying, by the first pressing member, the first downward pressing force to the pick roller when the pick roller is at the second position, and applying, by a second pressing member, a second downward pressing force to the pick roller when the pick roller is at the first position or the second position.

* * * * *